US008342881B2

(12) United States Patent
Lang et al.

(10) Patent No.: US 8,342,881 B2
(45) Date of Patent: Jan. 1, 2013

(54) SHIELD WITH INTEGRATED MATING CONNECTOR GUIDES

(75) Inventors: Harold Keith Lang, Cary, IL (US); Kent E. Regnier, Lombard, IL (US); Jerry A. Long, Elgin, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/062,973

(22) PCT Filed: Sep. 9, 2009

(86) PCT No.: PCT/US2009/056298

§ 371 (c)(1), (2), (4) Date: May 19, 2011

(87) PCT Pub. No.: WO2010/030619

PCT Pub. Date: Mar. 18, 2010

(65) Prior Publication Data

US 2011/0294347 A1 Dec. 1, 2011

Related U.S. Application Data

(60) Provisional application No. 61/095,450, filed on Sep. 9, 2008, provisional application No. 61/110,748, filed on Nov. 3, 2008, provisional application No. 61/117,470, filed on Nov. 24, 2008, provisional application No. 61/153,579, filed on Feb. 18, 2009, provisional application No. 61/170,956, filed on Apr. 20, 2009, provisional application No. 61/171,066, filed on Apr. 20, 2009, provisional application No. 61/171,037, filed on Apr. 20, 2009.

(51) Int. Cl.
*H01R 13/648* (2006.01)

(52) U.S. Cl. ..... 439/607.01

(58) Field of Classification Search ..... 439/607.01, 439/607.04, 607.17, 607.28
See application file for complete search history.

(56) References Cited

U.S. PATENT DOCUMENTS

| | | | | |
|---|---|---|---|---|
| 6,165,014 | A | 12/2000 | Kao et al. | |
| 6,416,361 | B1 | 7/2002 | Hwang | |
| 6,508,670 | B1 | 1/2003 | Hwang | |
| 6,729,906 | B1 | 5/2004 | Simmons et al. | |
| 6,793,526 | B1 | 9/2004 | Hsu et al. | |
| 7,033,210 | B1 | 4/2006 | Laurer et al. | |
| 7,322,854 | B2 * | 1/2008 | Long et al. | 439/607.28 |
| 7,344,409 | B2 * | 3/2008 | Lang et al. | 439/607.04 |
| 7,357,673 | B2 | 4/2008 | Long | |
| 7,455,554 | B2 * | 11/2008 | Long | 439/607.17 |
| 2005/0255726 | A1 | 11/2005 | Long | |
| 2006/0003622 | A1 * | 1/2006 | Lynch | 439/404 |
| 2007/0128937 | A1 * | 6/2007 | Long et al. | 439/607 |
| 2011/0223805 | A1 * | 9/2011 | Regnier et al. | 439/607.01 |

* cited by examiner

*Primary Examiner* — Chandrika Prasad
(74) *Attorney, Agent, or Firm* — Stephen L. Sheldon

(57) ABSTRACT

A shield is provided for use with a connector assembly that includes for sides that form an enclosure, one of the sides being a baseplate. The shield can include a plurality of guides positioned on the baseplate and the plurality of guides can be arranged in a pattern. Each guide can be formed by making two slits in the bottom plate so as to define a body portion of the guide and the body portion can be extended in the enclosure. Each guide can be supported by the baseplate at opposite ends of the body portion.

22 Claims, 34 Drawing Sheets

SHIELD WITH INTEGRATED MATING CONNECTOR GUIDES

REFERENCE TO RELATED APPLICATIONS

This application is a national phase of international application PCT/US09/56298, filed Sep. 9, 2009 and claims priority to U.S. Provisional Appln. No. 61/095,450, filed Sep. 9, 2008; to Appln. No. 61/110,748, filed Nov. 3, 2008; to Appln. No. 61/117,470, filed Nov. 24, 2008; to Appln. No. 61/153,579, filed Feb. 18, 2009, to Appln. No. 61/170,956 filed Apr. 20, 2009, to Appln. No. 61/171,037, filed Apr. 20, 2009 and to Appln. No. 61/171,066, filed Apr. 20, 2009, all of which are incorporated herein by reference in their entirety.

FIELD OF INVENTION

The present invention generally relates to connectors suitable for transmitting data, more specifically to input/output (I/O) connectors and shields used to provide shielding therefore.

BACKGROUND

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire for increased performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

Additionally, ancillary elements, such as heat sinks, light pipes and other elements are used in association with such shields. It is preferred that such elements are retained on the shield by clips or covers that reliably engage the housing and are easy to remove. Accordingly, an improved shield would be appreciated by certain individuals.

SUMMARY OF THE INVENTION

A shield is provided for use with a connector, the shield having a plurality of walls that are joined together to form a hollow interior into which a connector may be inserted. The shield can be stamped and formed from sheet metal and assembled from multiple pieces to form a hollow enclosure that includes four sidewalls and a rear wall. One of the sidewalls can take the form of a baseplate and can have a series of guides and/or keys integrated therewith. The shield includes an opening that, in combination with the side walls, defines a passage that leads to the mating face of the connector.

The connector can be formed of an insulated housing that includes a plurality of terminals that may be supported by a wafer, or lead frame, and each wafer can support multiple terminals therein. The connector provides slots into which circuit cards of an opposing mating connector may be inserted and in an embodiment may include multiple slots in one passage.

In an embodiment, an EMI gasket is provided in the form of a two piece collar. The gasket can have two halves and these two halves are attached to the shield at the opening in a manner to reliably fix then to the shield. In addition, one or more of the sidewalls (other than the sidewall that forms the baseplate) may be lanced and formed to provide a side support for ancillary components, such as a heat sink or a light pipe array. In an embodiment, the side support can provide a hard edge on a first side of the side support and a chamfered edge on a second side so as to provide a side support that supports allows for secure retention and easy installation.

BRIEF DESCRIPTION OF THE DRAWINGS

Throughout the course of the following detailed description, reference will be made to the drawings in which like reference numbers identify like parts and in which.

DETAILED DESCRIPTION OF THE ILLUSTRATED EMBODIMENTS

As required, detailed embodiments are disclosed herein; however, it is to be understood that the disclosed embodiments are merely exemplary. Therefore, specific details disclosed herein are not to be interpreted as limiting, but merely as a basis for the claims and as a representative basis for teaching one skilled in the art. Furthermore, it is contemplated that the depicted features may be used in combinations that might not be explicitly disclosed herein and the depicted combinations are not intended to be limiting in that regard unless otherwise noted.

As noted above, there is a desire to increase the density of connectors and this is difficult to do for plug-style connector with out increasing the width of the connectors of many connectors system work have a pitch that is difficult to reduce further. Increasing the width of the plug connectors leads to difficulty in fitting the plug into standard-width routers and/or servers. For increased density, therefore, a stacked connector has sometimes been used to provide two vertically stacked ports, each port having a mating slot. These connectors operate at high data transfer speeds, and therefore may require electromagnetic interference ("EMI") shielding, so as to protect the signals being transmitted and/or to prevent undesirable emissions from the connectors.

For certain types of stacked connectors, such as SFP-style connectors, the connector can be enclosed in a conductive metal shielding shield that has a longitudinal bay in which the connector is housed, and which accommodates a mating plug-style connector inserted into the bay through an opening shield. The bay is elongated and it has an open space between the mating face of the connector and the opening of the shield. One issue that is posed by this design is the need to guide the plug to the connector positioned within the shield. It has been determined to be desirable to assist in guiding the opposing plug connector (or module) into mating engagement with the connector housed inside the shield with guides and certain benefits can be realized if the guide(s) is on the floor of the shielding shield.

It is easy to form guides in a plastic or diecast guide frame. This is because of the molded nature of the guide frame. However, the walls of the plastic and diecast guide frames are necessarily large due to the molding process, which negates the intent of reduction of size of electronic components. It is more difficult to form guides in a shield formed from sheet metal. Current designs have an engagement tab that is stamped and formed from the sheet metal. That tab is bent upwardly into the interior space of the shielding shield. The tab it is susceptible to deformation caused by repeated bending due to contact (such as stubbing) which may occur during the insertion and removal of the mating plug connector, and after repeated contacts, the tab may be deformed to a point where it does not function well as a guide.

Figure 1:
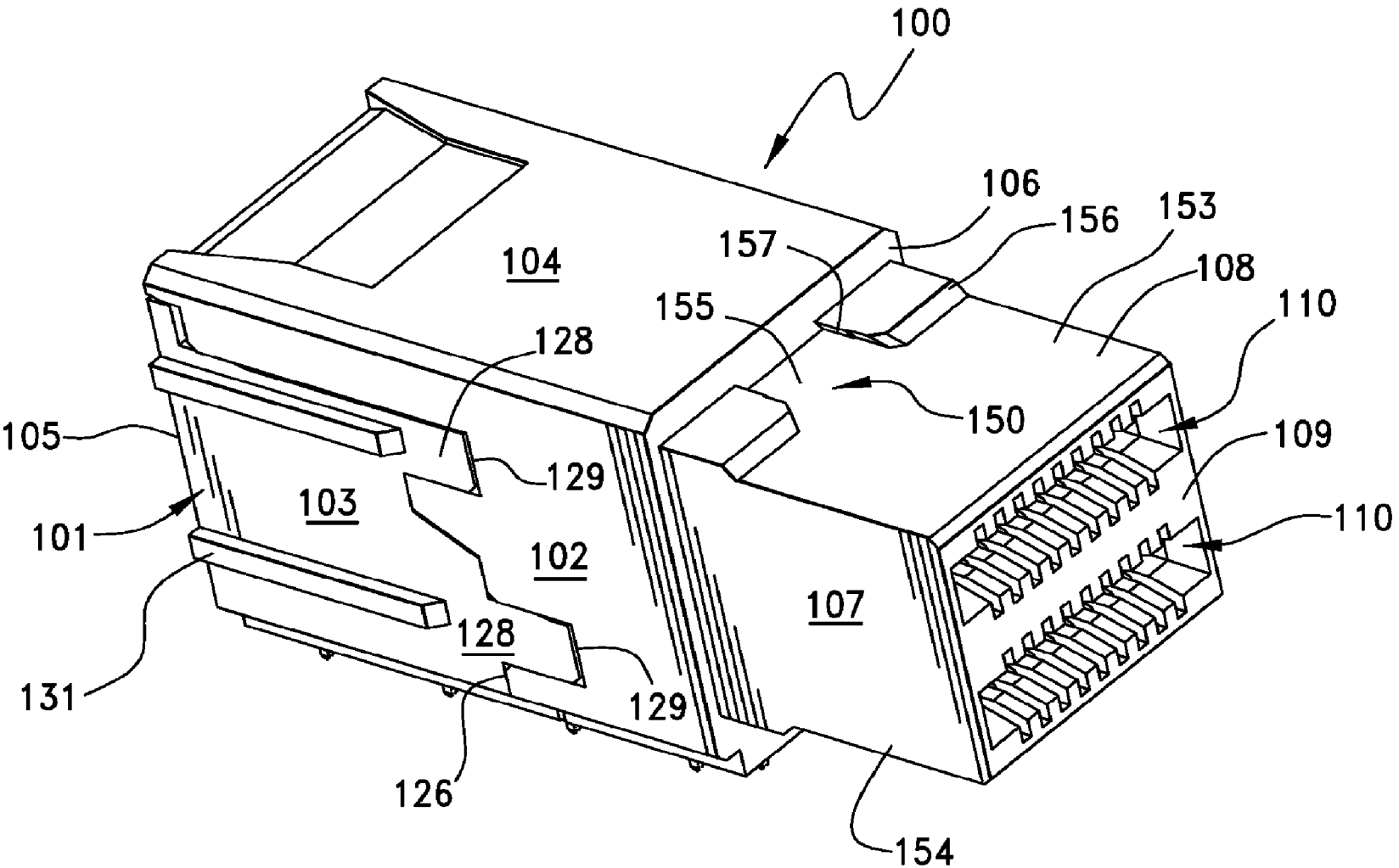
FIG. 1 is a perspective view of a connector that may be used in combination with depicted shields.

FIG. 1 illustrates a connector assembly 100 that can be provided in a shield. The connector assembly 100 takes the form of an insulative connector housing 101 which is illustrated as having two interengaging first and second (or front and rear) pieces, or parts 102, 103. The connector housing 101, as shown in FIG. 1 has a wide body portion 104 that extends between a rear face 105 and the front face 106. A mating portion 107 that takes the form of an elongated nose portion 108 projects forwardly of the front face 106 and terminates in a mating face 109. The mating face 109 may have one or more circuit card-receiving slots 110 that are formed widthwise in the mating face 109, with two such slots 110 being shown in FIG. 1.

Figure 2:
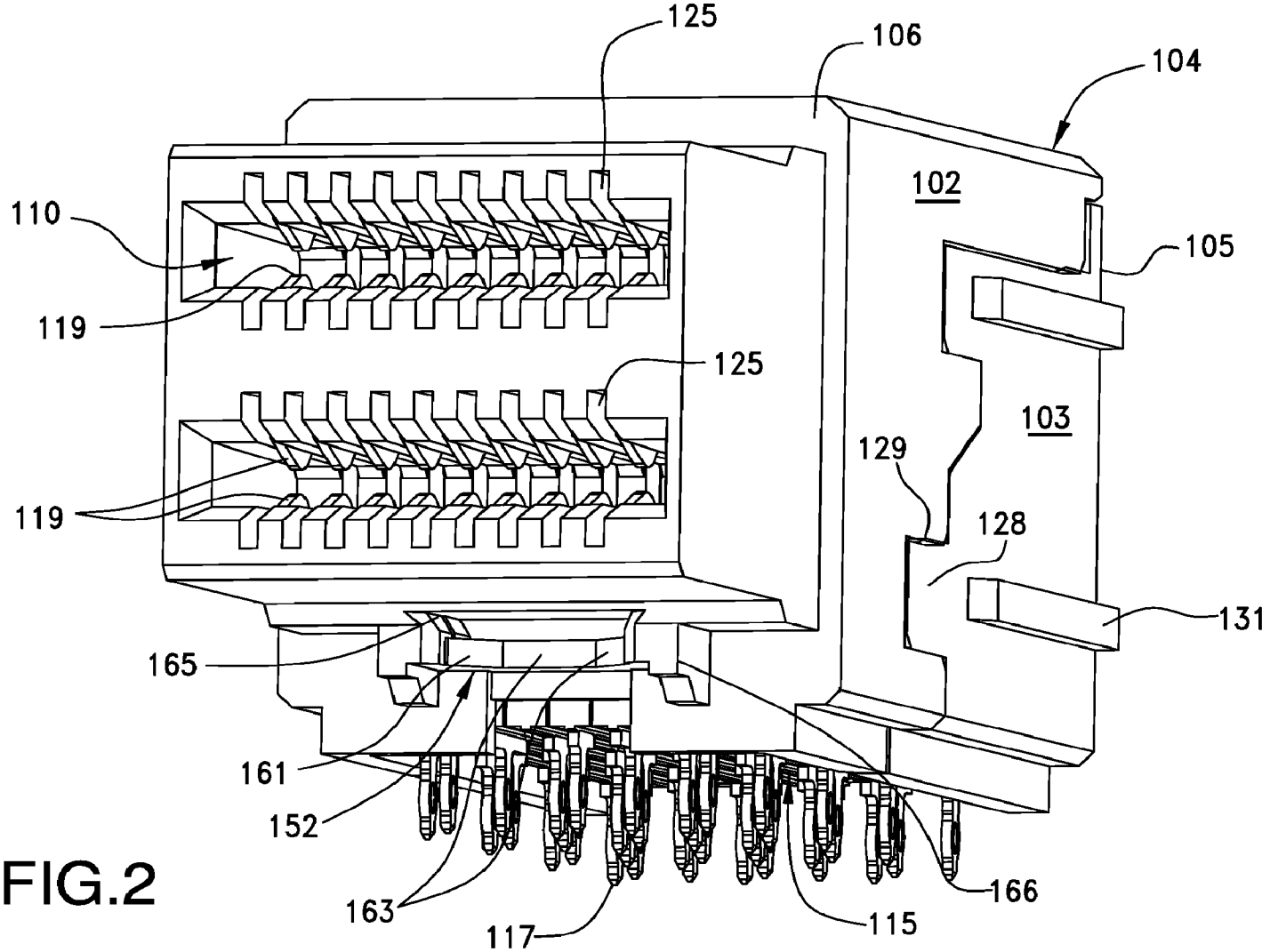
FIG. 2 is a frontal perspective view of the connector of FIG. 1.
Figure 3:
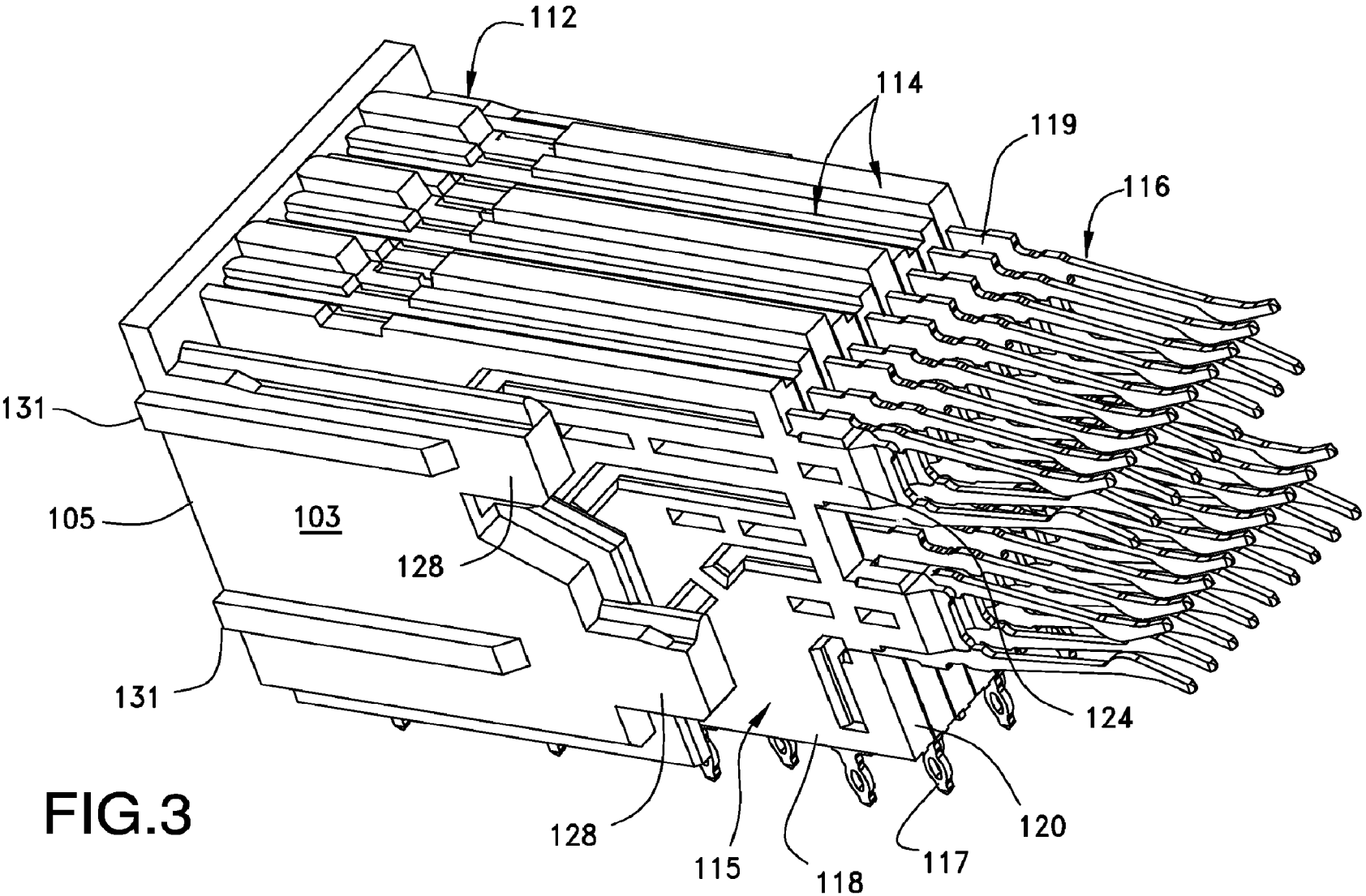
FIG. 3 is a perspective view of the connector of FIG. 1 laying on its side with one of the housing portions removed to illustrate the terminal assemblies housed in the connector.

As shown in FIGS. 2-3, the connector housing 101 has a hollow interior portion 112 that receives a plurality of terminal assemblies 114 that take the form of insulative frames, or wafers, 115. Each such frame 115 contains a plurality of conductive terminals 116 having tail portions 117 projecting out from one edge 118 and contact portions 119 projecting from a second edge 120 of the frame 115. In the illustrated embodiment, the two edges 118, 120 are adjacent each other. The terminals 116 further include body portions 121 that interconnect the tail and contact portions 117, 119 together.

The terminal assembly frames 115 may have openings 123 formed therein in the form of slots that extend along the terminal body portions 121 to expose them to air and thereby affect the terminal impedance.

The terminal assemblies are held together as a block within the connector housing 101 in a manner such that the terminal tail portions 117 extend out through the bottom of the connector housing 101 and the terminal contact portions 119 extend from the edges 120 of their frames 115 into the housing nose portion 108. The terminal contact portions 119 can be arranged in the frames 115 as pairs of terminals for differential signal transmission, and each pair can be positioned on one side of one of the card-receiving slots 110.

The terminals 116 as noted above, project forwardly from the leading edge 120 of the terminal assembly frames 115, and portions 124 of the frames 115 extend past the leading edge 120. As can be understood from the drawings, the terminal contact portions 119 are cantilevered and act as contact beams that deflect away from the slots 110 when a circuit card is inserted therein. In order to accommodate this upward and downward deflection of the terminal contact portions 119, the nose portion 108 of the connector housing 101 has terminal-receiving cavities 125 (FIGS. 1 & 2) that extend vertically, a preselected distance, above and below centerlines of each slot 110.

Returning to FIGS. 1 and 3, the connector housing 101 has two pieces 102, 103 which mate along an irregular mating line 126 that extends upwardly through the sides of the connector housing 101 along a path that extends from the front to the rear of the connector housing 101. With this irregular configuration, a pair of rails 128 and channels 129 are defined in the two pieces 102, 103 with the rails 128 fitting into the channels 129. Outer ribs 131 may also be formed on the exterior side surfaces of the rear housing part 103 and these ribs 131 are preferably horizontally aligned with the rails 128 to provide reinforcement to the rails 128, but also to provide a means for positioning the connector subassembly 100 in an exterior housing or shroud as will be described in greater detail to follow.

Figure 7:
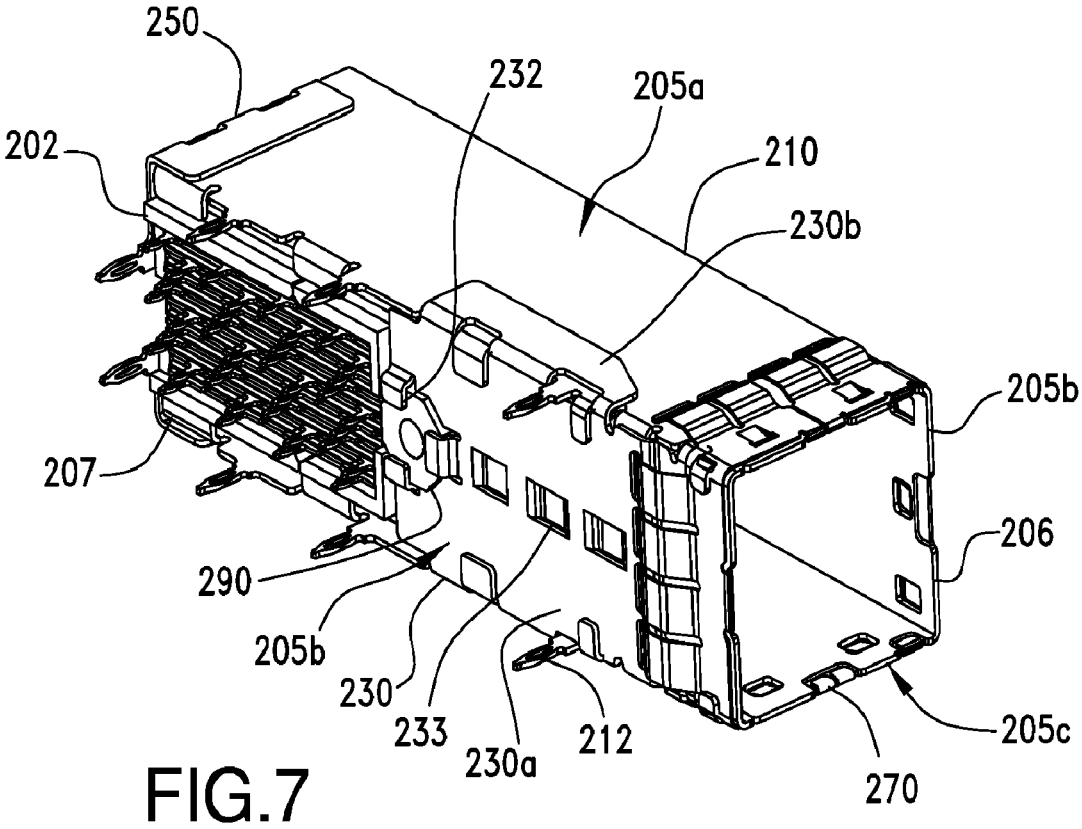
FIG. 7 is a perspective view of the shield of FIG. 5 removed from the circuit board and lying on its side to show how the baseplate is affixed to the housing after insertion of the connector assembly.
Figure 8:
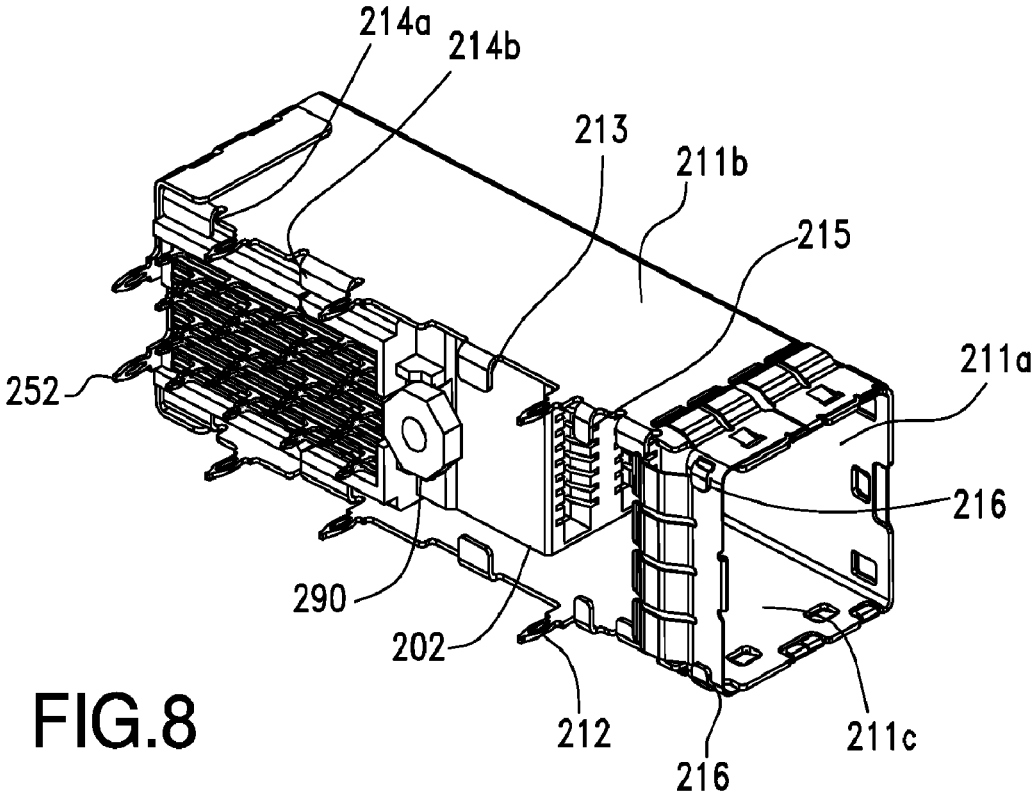
FIG. 8 is the same view as FIG. 7, but with the baseplate removed for clarity to illustrate the internal connector assembly and fastening member.
Figure 9:
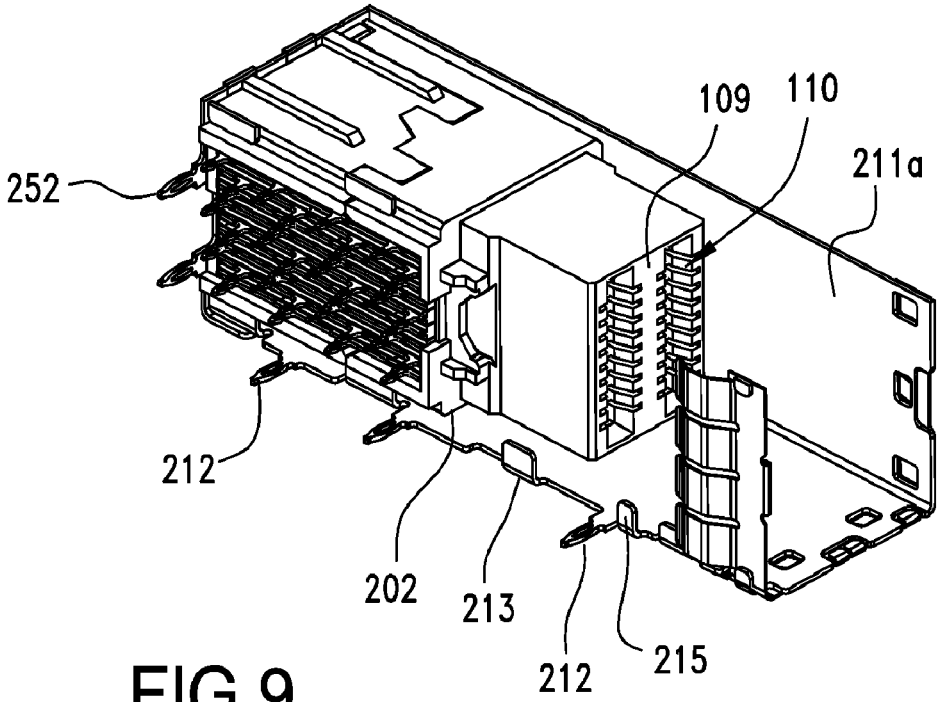
FIG. 9 is the same view as FIG. 8, but with a sidewall of the shield and the fastening member removed for clarity.

FIGS. 4-18 illustrate a shield 200 which is used to house the connector assembly 100, and provide EMI shielding to it. As depicted, the shield 200 provides a plurality of sidewalls that provide a hollow interior and which substantially envelopes the connector assembly 100 except for a bottom opening 207 (visible in FIG. 7) from which the terminal tail portions 117 of the connector project.

In this application, the bottom engagement recess 152 of the connector housing 101 may also contact and engage a fastening nut (FIG. 8) that is used to fasten the external shroud 200 to a circuit board. The exterior ribs 131 of the connector housing 101 also will preferably frictionally engage the inner sidewalls of the external shroud 200 to provide a means of centering the connector housing 101 within the hollow interior of the external shroud.

Figure 4:
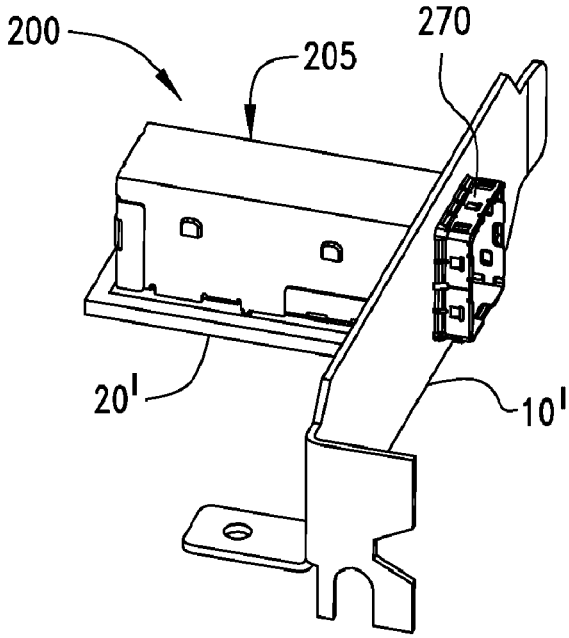
FIG. 4 is a perspective view of a shield which encloses a connector assembly and which has been fitted and which is attached to a mounting plate, or bracket.
Figure 5:
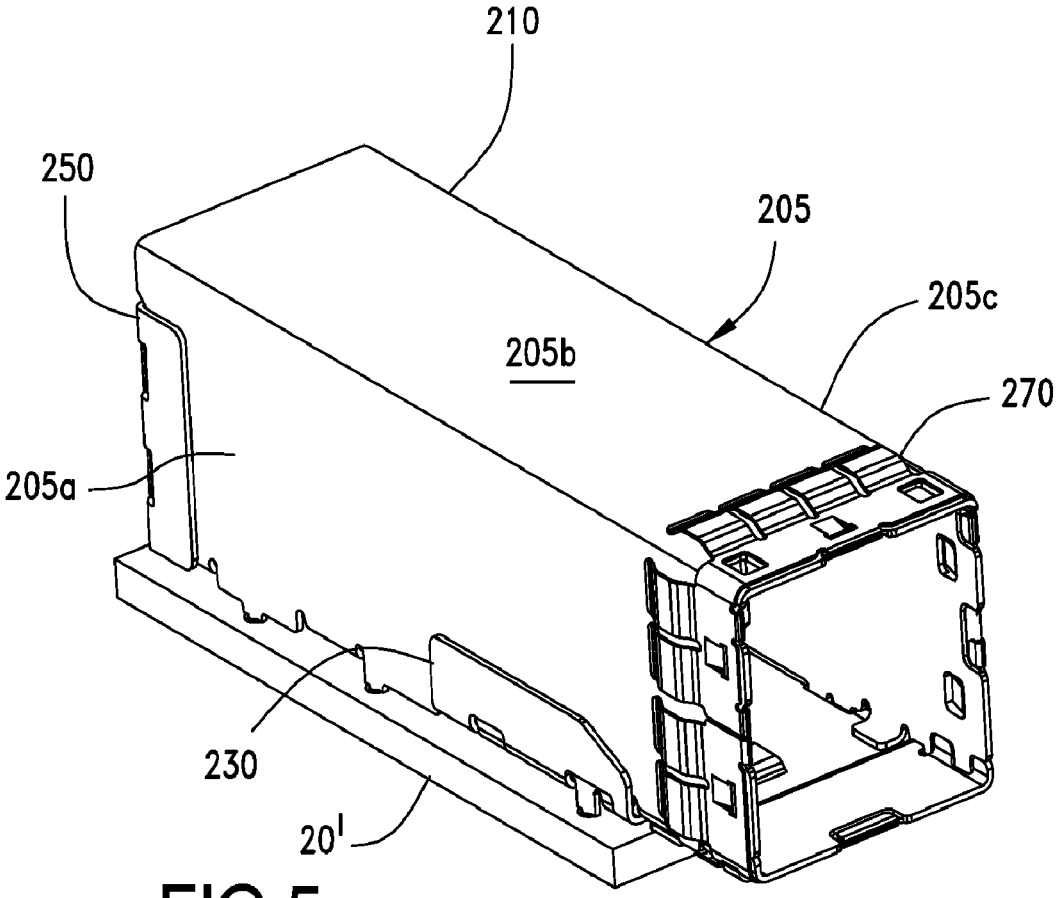
FIG. 5 is a perspective view of the shield shown mounted solely to a circuit board.
Figure 6:
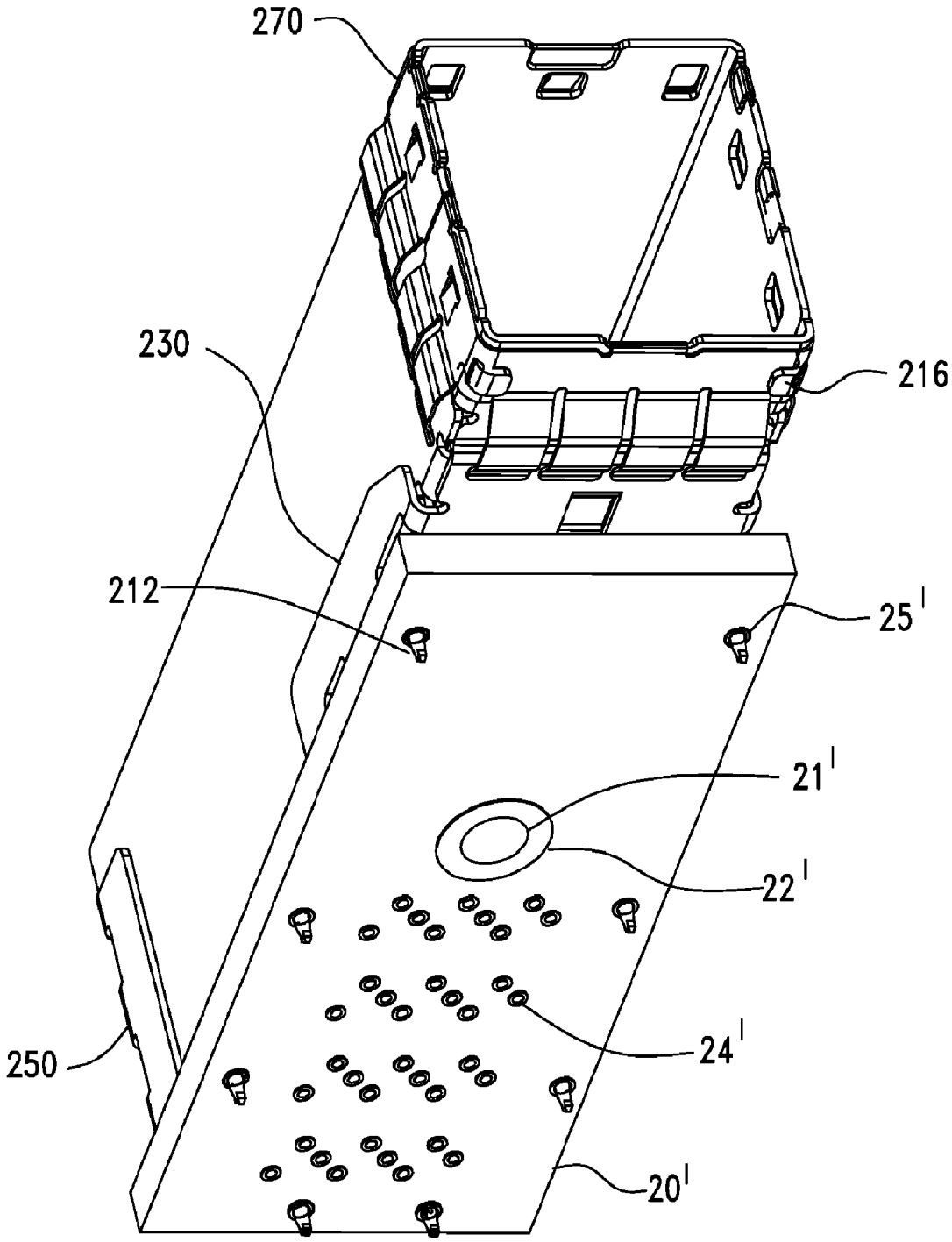
FIG. 6 is the same view as FIG. 5, but taken from the underside thereof.

In FIG. 4, a shield 200 is depicted mounted to an opening of a mounting bracket, or faceplate 10', which engages an EMI gasket collar 270 encircling the shield at its opening 206. The shield 200 provides a port 205 (FIG. 5) that is partially defined by a first side 205*a*, a second side 205*b* and a third side 205*c*. These sides 205*a-c* and the baseplate 230 cooperatively define the port 205 that receives the connector assembly 200. As depicted, the first, second and third side 205*a-c* provide a cover 210 that is formed on a single piece of metal. The cover 210 could also be formed of two or three pieces joined together but the use of a single piece has been determined to be beneficial from a manufacturing standpoint.

The port 205 engages the circuit board 20' and is coupled thereto. In an embodiment, the connector may include a threaded member 290, as noted above, which may be an internally threaded member, such as a threaded nut, that is supported by the port 205 and provides a mechanism by which the connector assembly 200 may be fastened to the circuit board 20'. As can be appreciated, a screw can be inserted through an aperture 21' also in the circuit board 20', which may include force spreader 22', also in the circuit board so as to engage the threaded member 290 and secure the connector to the board, thus providing additional structural rigidity to the mounted assembly as compared to merely using tails 212, 252 extending from the port 205 that engage and are soldered to the PCB. As can be further appreciated, the threaded member could also have a convention screw-like configuration that extends through the circuit board when the two are joined and engages a nut.

Figure 10:
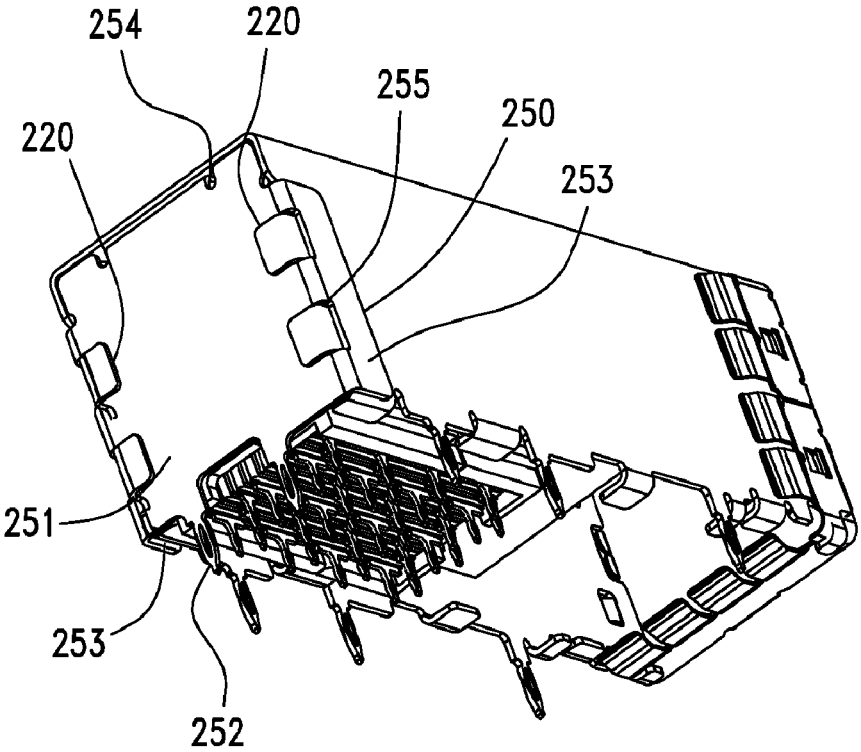
FIG. 10 is a reverse angle view, taken from the rear of the shield of FIG. 8 to show the manner in which the rear wall of the housing is attached to the sidewalls thereof.
Figure 11:
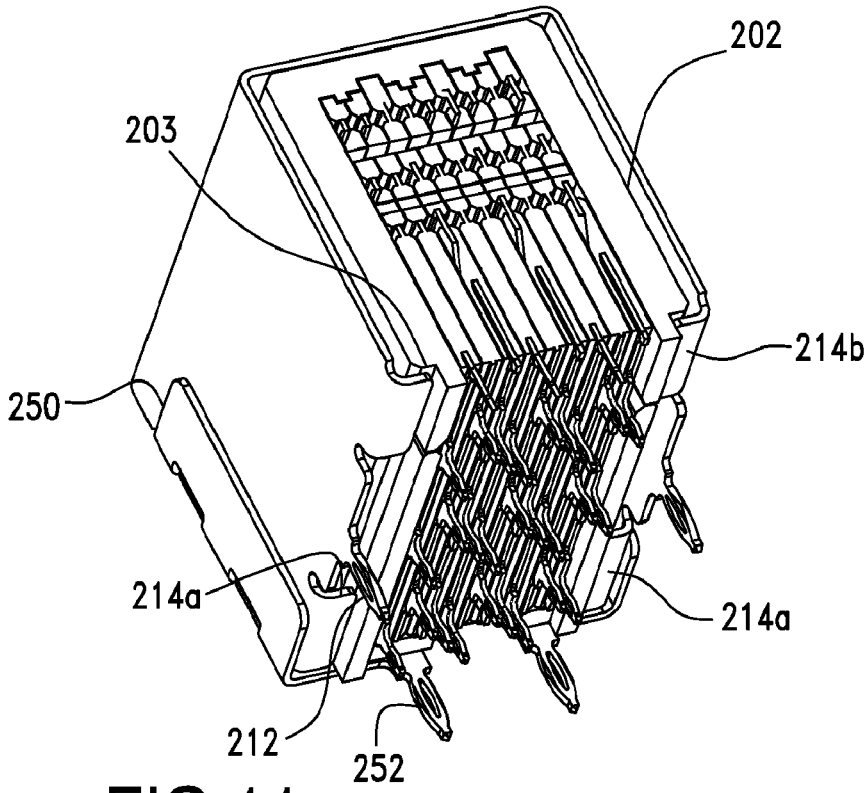
FIG. 11 is a detail view of the rear of the shield, illustrating how the connector assembly is retained in the housing.
Figure 12:
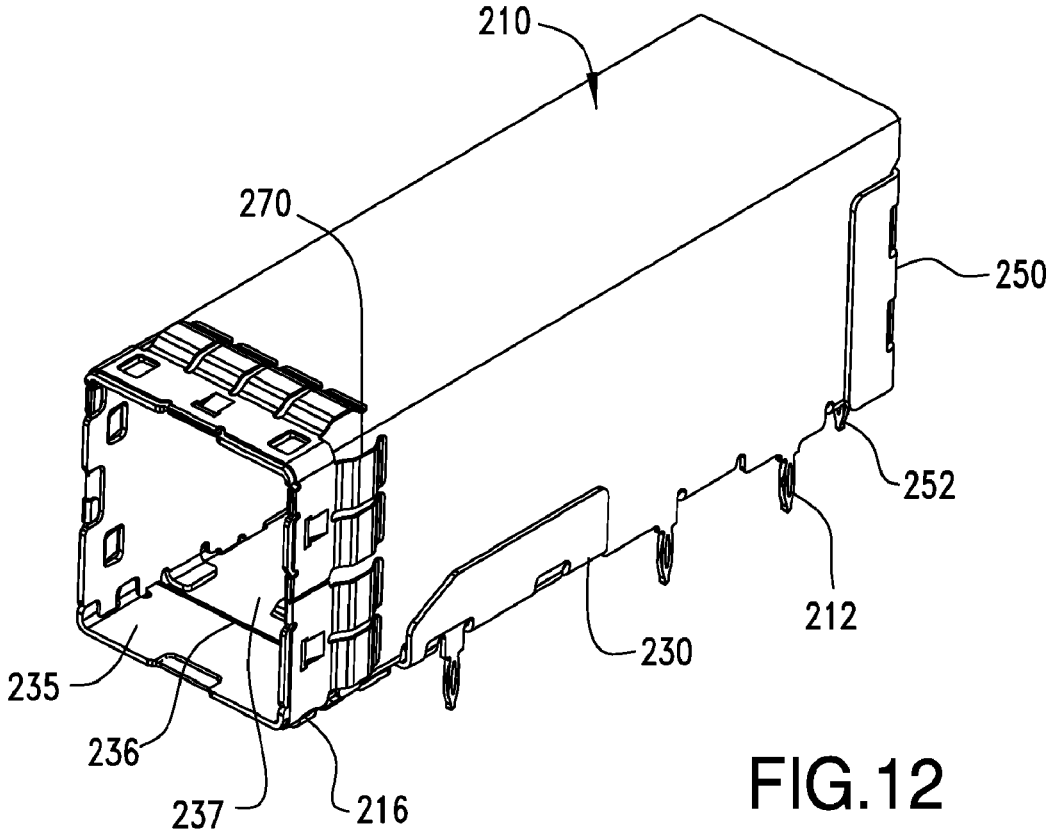
FIG. 12 is a perspective view of the shield without the internal connector assembly in place therein.
Figure 13:
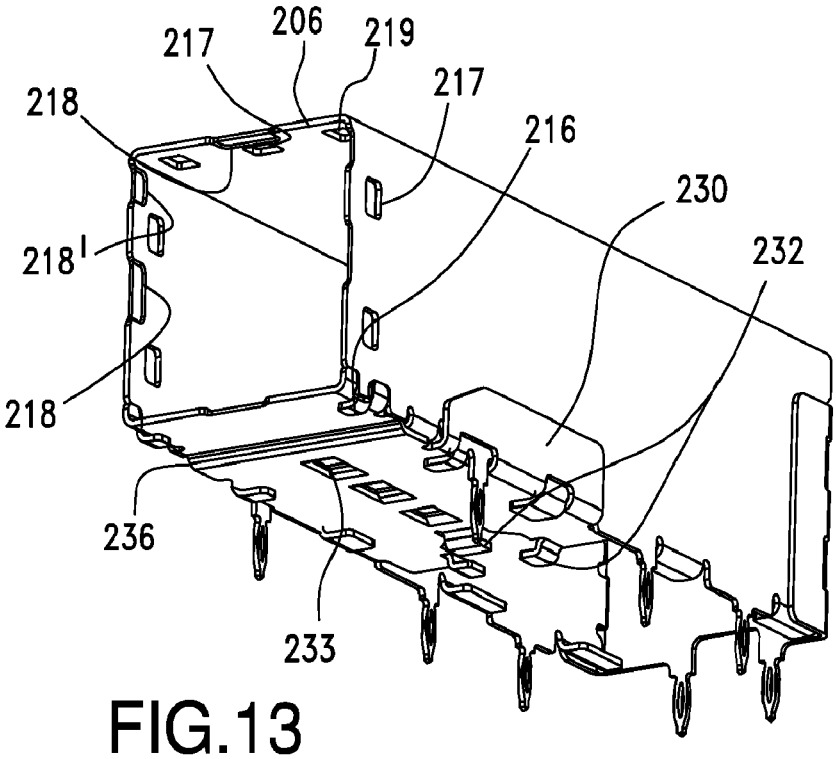
FIG. 13 is a perspective view of FIG. 12, taken from below with the EMI gasket collar removed.

As depicted, the port 205 includes three distinct parts: the cover 210, a baseplate 230 and a rear plate 250 that are coupled together by way of a plurality of engagement tabs. Such a construction allows the portions of the port 205 to be assembled in a desired order. For example, the cover 210 may be formed in a U-shape manner, as shown, and the baseplate 230 may be assembled and coupled to the cover 210 via engagement tabs, and then the rear plate 250 may be assembled to the cover 210 and the baseplate 230 and secured with bent tabs so as to form the port 205. Prior to completing the assembly, (e.g., before coupling the rear plate 250), the connector housing 101 can be inserted into the partially formed port so as to provide an connector assembly that may then be mounted on a circuit board (FIG. 10).

More specifically, the cover 210 is generally U-shaped with a top wall and two sidewalls as shown in the illustrated embodiment. In an embodiment, the cover 210 is formed as a single unit, and it includes a plurality of engagement tabs, 213 and 215, that are formed along bottom edges thereof. These tabs 213, 215 are positioned to engage the baseplate 230 to secure the cover 210 and baseplate 230 together. The baseplate 230 further is held between the lower tabs 213, 215 of the cover 210 and front engagement tabs 226 so as to securely couple the cover 210 and baseplate 230 together. As depicted, the baseplate 230 also includes a pair of side panels 230*b* that are bent upwardly out of the plane of the baseplate and adjacent the sidewalls of the cover 210 so as to provide overlapping walls that help strengthen the port 205.

Figure 14:
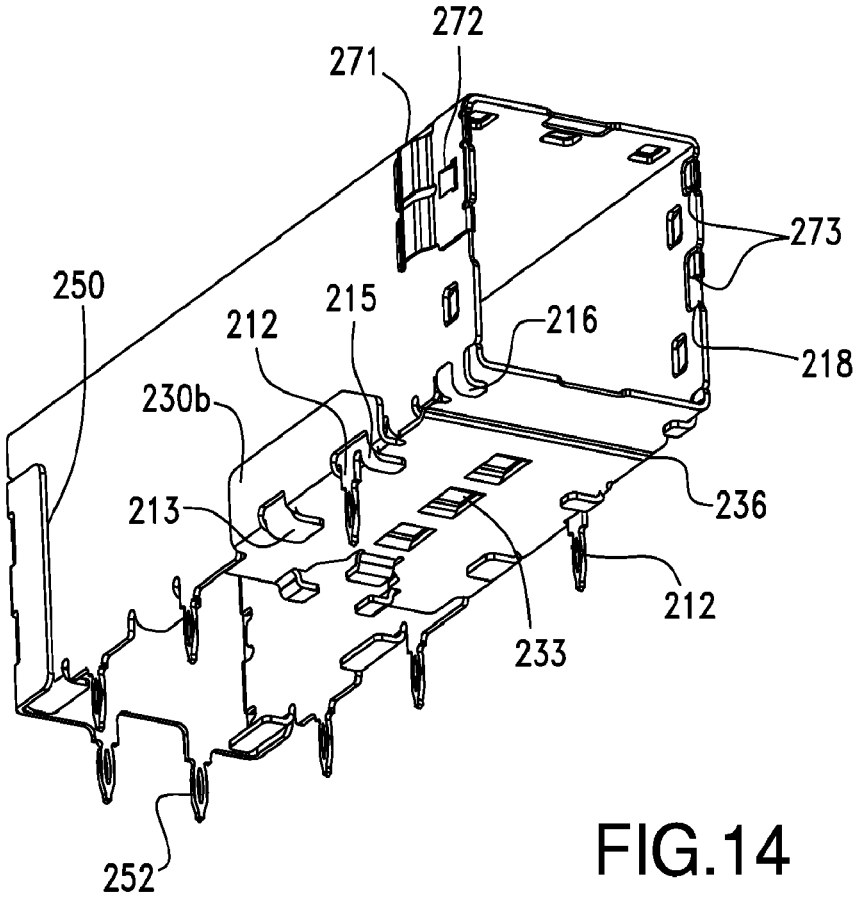
FIG. 14 is the same view as FIG. 13, but taken from a different angle and with the top half of the EMI gasket collar in place thereon.
Figure 14A:
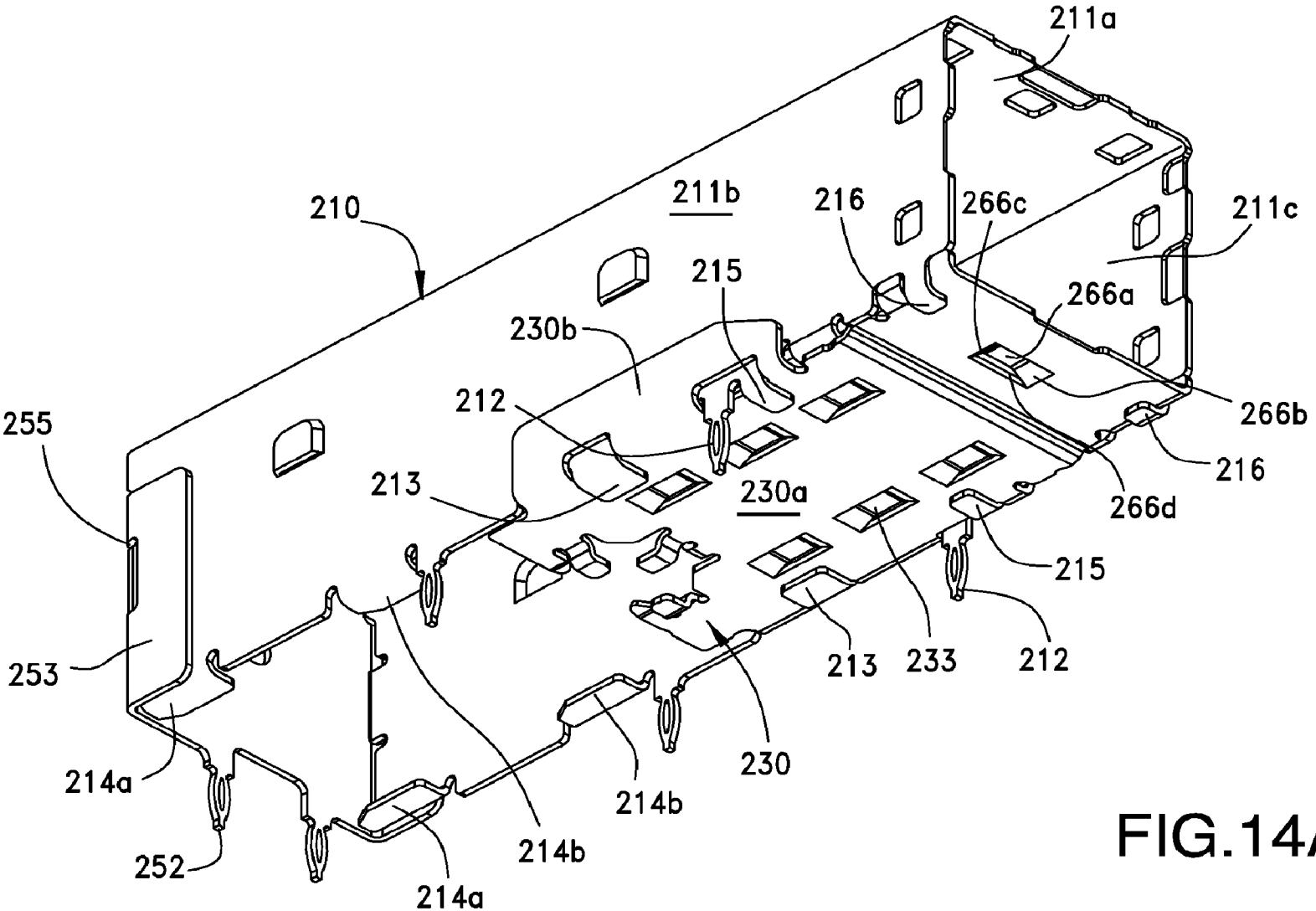
FIG. 14A is the same view as FIG. 14 but with the top half of the EMI gasket collar removed and taken from a lower angle.
Figure 14B:
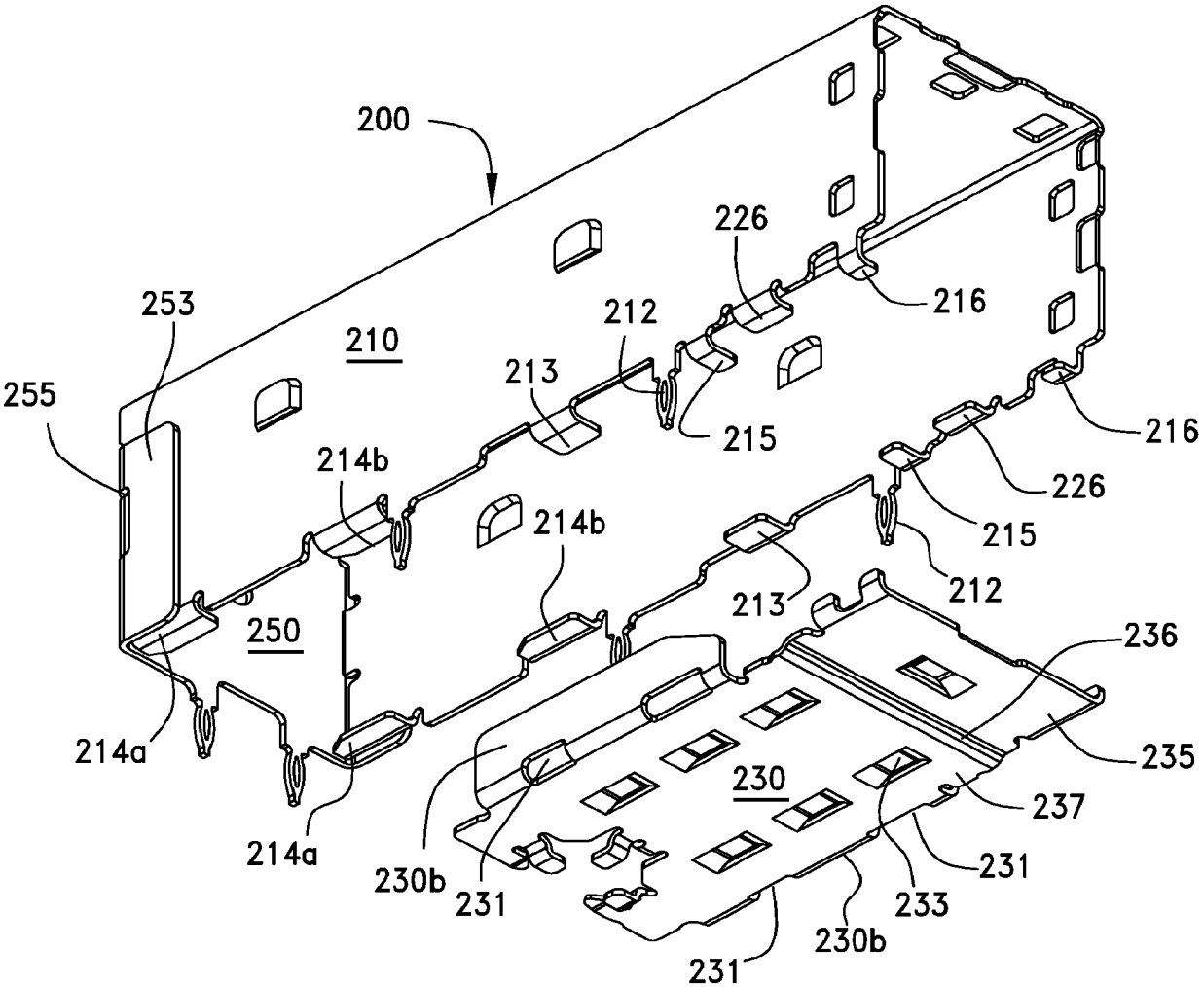
FIG. 14B is the same view as FIG. 14A but with the bottom plate removed and spaced apart from the housing to show the alignment of the engagement tabs of the housing with the slots of the baseplate.
Figure 14C:
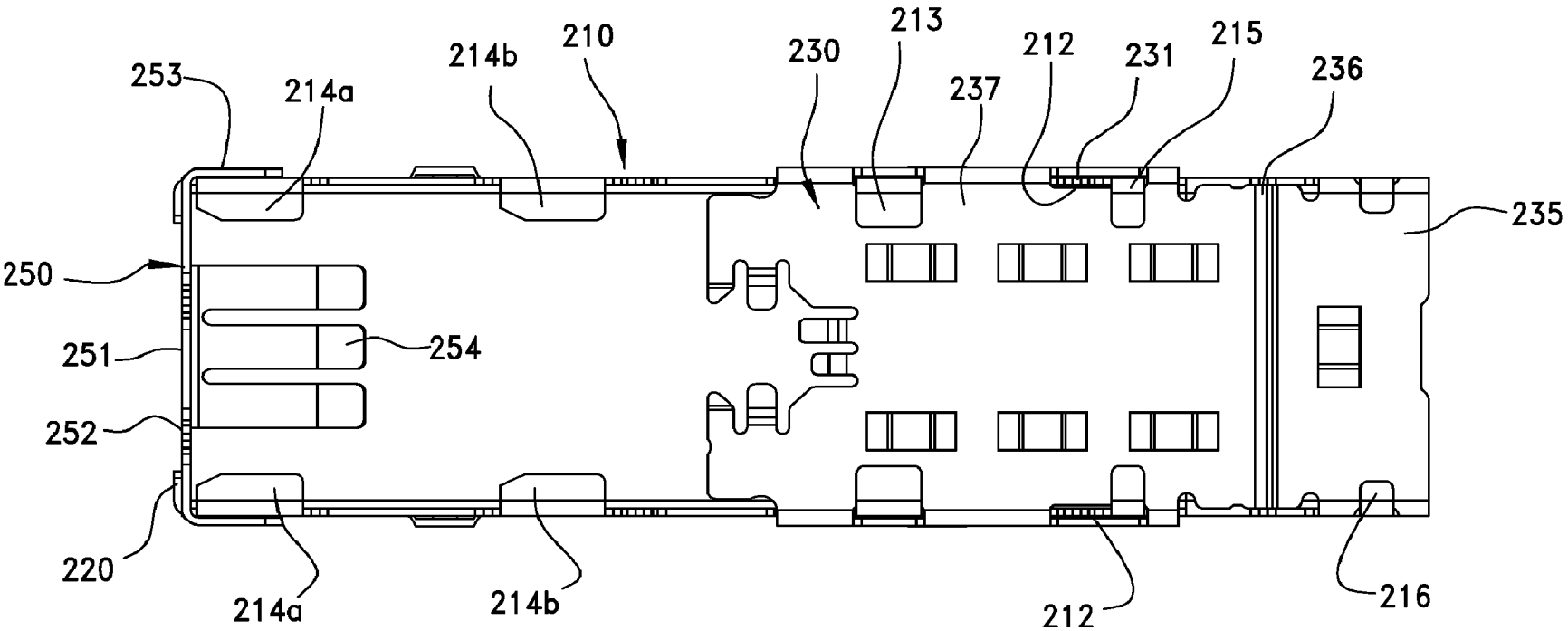
FIG. 14C is a bottom plan view of the housing of FIG. 14A.

This manner of engagement is shown best in FIGS. 14A-14C where it can be seen that the baseplate 230, when its side panels 230*b* are bent upwardly, can have a general U-shape that is aligned opposite the U-shape of the cover 210. These side panels 230*b* have slots 231 disposed therein that are aligned with the engagement tabs 213, 215 of the cover 210. The front support tabs 226 of the cover 210 provide a measure of support for the baseplate 230 and engage it by contacting confronting portions of the inner surfaces of the baseplate, while the first shield engagement tabs 213, 215 extend through the slots 231 and are bent over the baseplate 230 so that they bear against the bottom surfaces thereof. The frontmost slot 231 is preferably of a longer width than the rearmost slot so as to accommodate, as illustrated more clearly in FIGS. 14A-C, the combined engagement tab-tail combination 215-212 as described in more detail below. The cover 210 also includes gasket retaining tabs 216 disposed at the front end of the cover 210. As shown in Figures, especially FIGS. 6 & 14C, these tabs 216 extend through slots on the lower half of the gasket collar 270 and are bent thereupon to retain it in place at the front of the shield. The combination of these engagement tabs and the overlapping side panels allows the cover and the baseplate to be held together in a secure manner.

Similar features may be used to secure the rear plate 250 to the cover 210. The rear plate 250, which has a rear wall 251, is depicted with has two side panels 253 that extend forwardly from the rear wall 251 and overlap the cover 210 on sides 205*a* and 205*c*. The side panels 253 have slots 255 formed thereon in alignment with the rear edges of the sides 205*b*, 205*c*. The port 205 has a series of engagement tabs 220 that are formed along the rear edges and these tabs 220 are received in and extend through the slots 255 and then are bent over, adjacent to the rear wall 251. The rear plate 250 may also include a support tab 254 that is wider than the tabs 220 which is placed into contact against the inner surface of the side 205*b*. As depicted, the cover 210 includes tails 212 that are configured to engage apertures (such as plated vias) in a circuit board so as to electrically couple the shield to ground circuits on the circuit board. The baseplate 230, in turn, securely holds the threaded member 290 in place to prevent the threaded member 290 from rotating when a mating threaded member is coupled to the threaded member 290.

Figure 15:
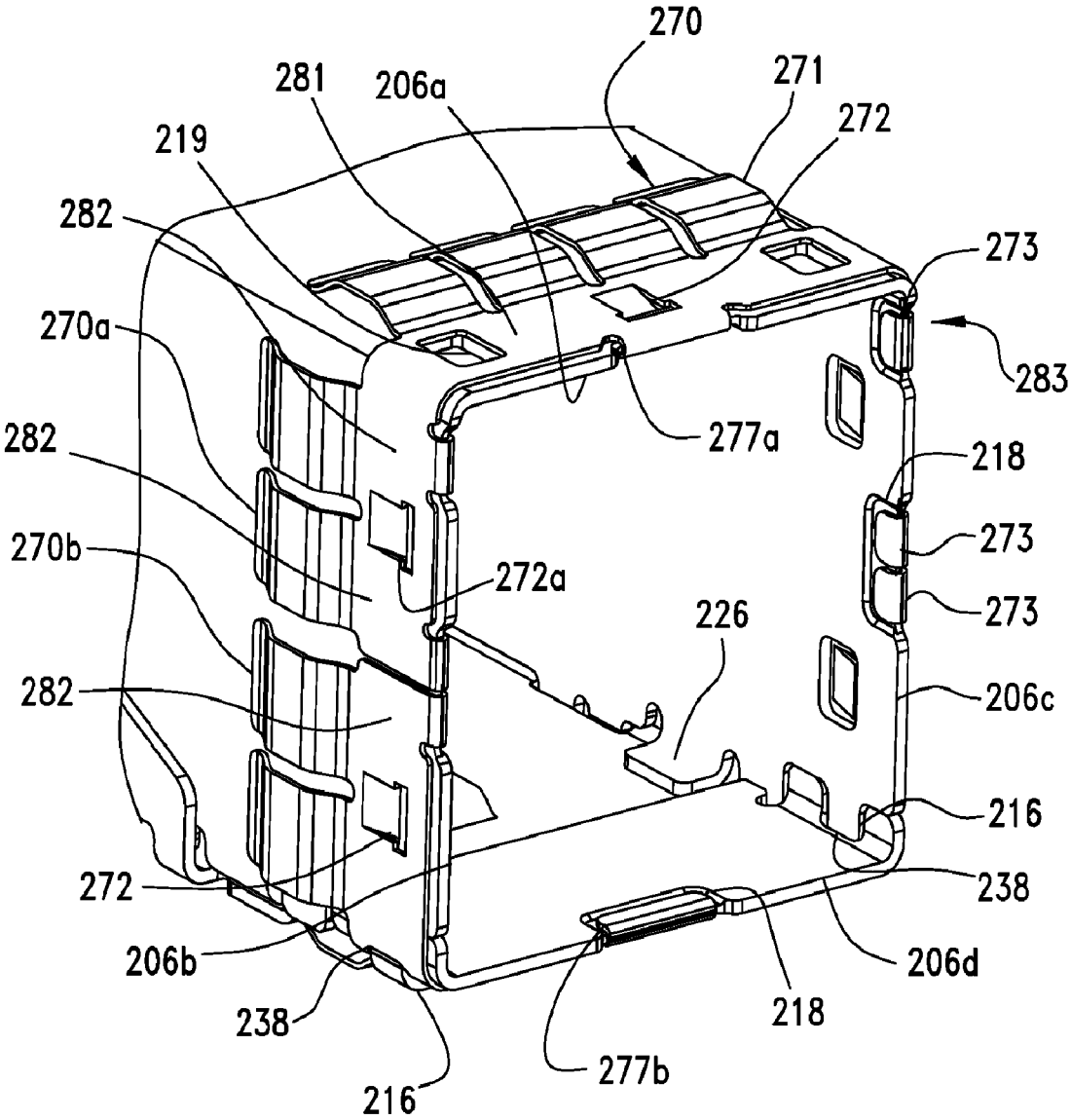
FIG. 15 is an enlarged detailed view of the front of the shielded housing showing the interior thereof.
Figure 16:
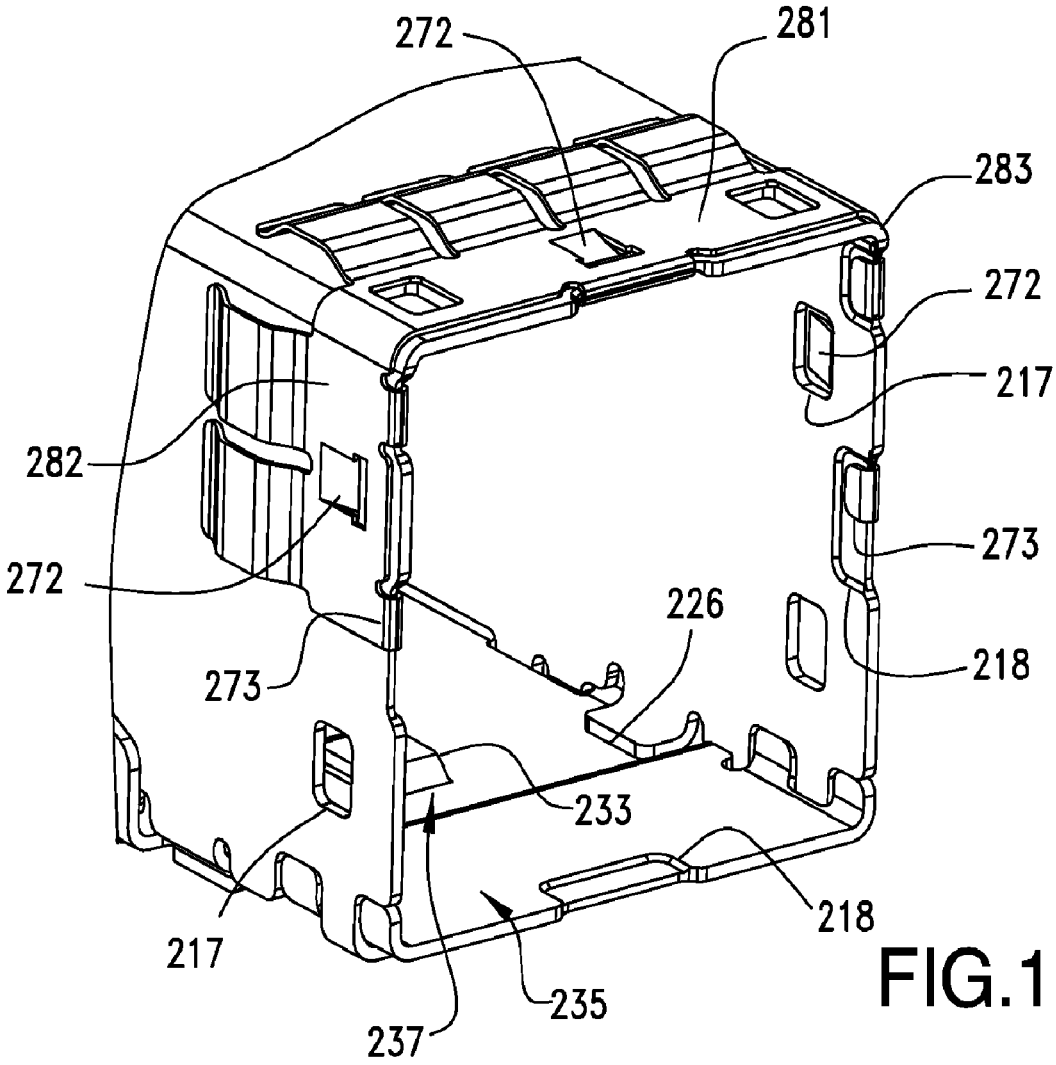
FIG. 16 is the same view as FIG. 15, but with the lower half of the EMI gasket collar removed for clarity.
Figure 17:
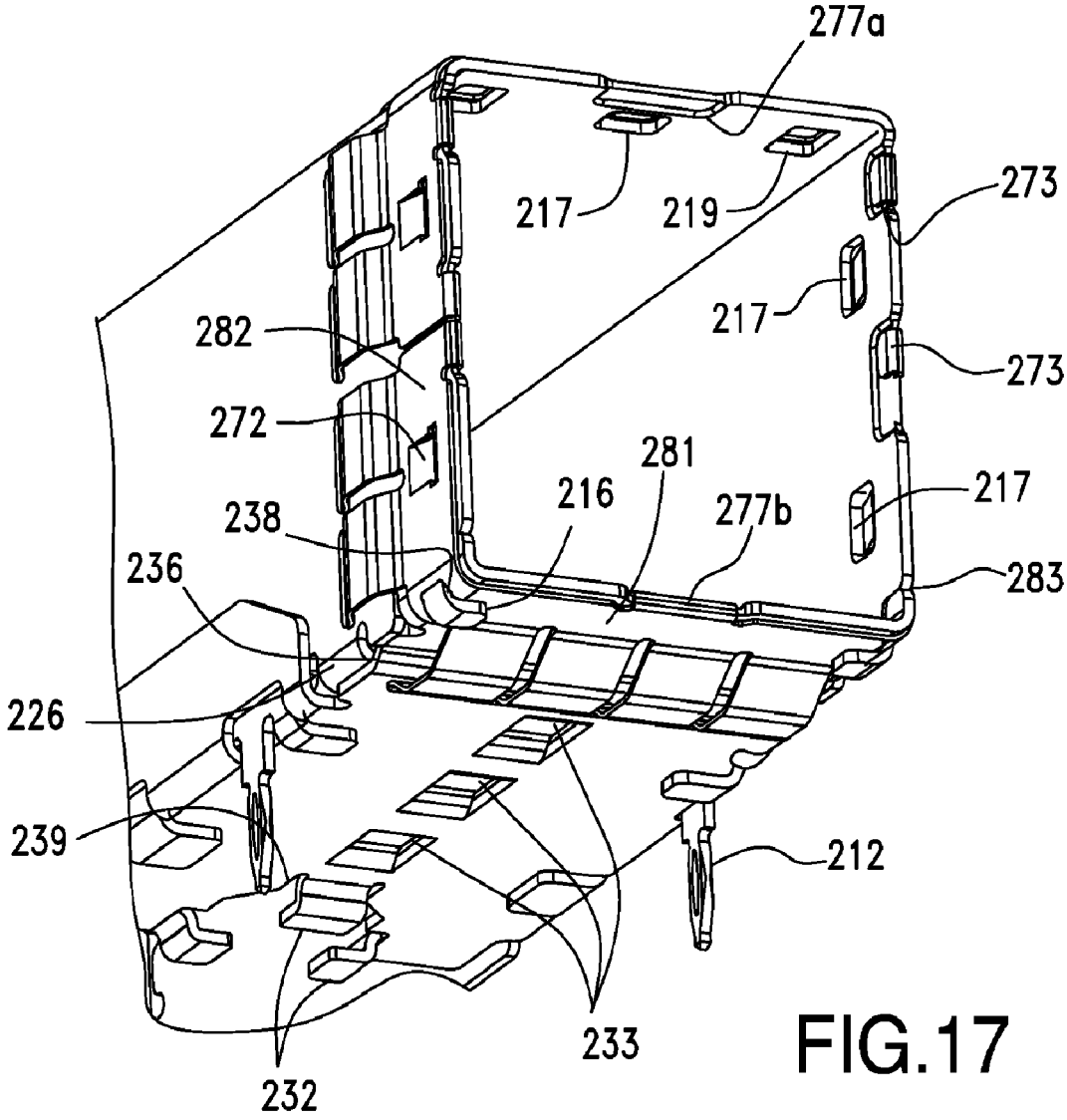
FIG. 17 is the same view as FIG. 16, but taken from the underside thereof.

For many configurations it is desirable to include an EMI gasket 270, shown as a collar in the various Figures, so that a reliable electrical ground can occur between the mounting bracket 10' and the port 205. As shown best in FIG. 15, the EMI gasket collar 270 includes a first half 270*a* and a second half 270*b* that together extend around the perimeter of opening 206. The gasket collar is provided with slender fingers 271 as is known in the art, which are formed as part of the body portion of the gasket half, and provide an outward bow for contacting the walls of an opening in a mounting bracket 10' and free ends that contact the exterior surfaces of the shield sidewalls 205*b*. 205*c*. Engagement tabs 273 are provided at varying locations around the gasket collar 270 and are configured to be received within recesses 218 so that a minimum of space is occupied with still providing a reliable means to fasten the EMI gasket 270 to the edges 206*a*, 206*b*, 206*c*, 206*d* of the opening 206 (FIG. 15). These tabs 273 at least preferably provide two points of attachment of the gasket half 270*a*, 270*b* to the shield and with the top and bottom wider engagement tabs 277*a*, 277*b*, at least three points of attachment are provided.

To further secure the EMI gasket 270, securing tabs 272 extend into apertures 217 that are formed in the shield walls. These tabs 272 are fixed at one end to the gasket collar 270 and are sent inwardly toward the front of the opening 206, where they terminate in free ends. These free ends 272*a* prevent the gasket collar 270 from sliding off the cover 210 in the forward direction, while the tabs 277*a*, 277*b* which are folded over the front edge of the opening 206 provide a stop for the gasket collar 270 and prevent it from sliding rearwardly away on the port 205 away from the opening 206, during insertion of the shield 200 into mounting brackets and the like. In addition, EMI-retaining tabs 216 extend through two apertures 238 in the bottom half 270*b* of the gasket 270 and are bent over to hold the gasket 270 in place. On top and bottom opposing sides, a single wider tab 277*a*, 277*b* is shown engaging a recess 218. The wider tab 277*a*, 277*b* helps secure the base portions 281 of the EMI gasket 270 that extends a full width of edges 206*a*, 206*c* while multiple smaller tabs are suitable for securing sides 282, 283 of the gaskets to edges 206*b*, 206*d*. Coincident openings 219 can be formed in both the gasket top half 270*a* and the side 205*b* so as to receive engagement hooks of the opposing mating connector, if such engagement is desired.

As can be appreciated, when a module is inserted, it must traverse the passageway provided by the port 205 for a distance before engaging the housing 101. Existing tab designs provided a tab that was susceptible to being bent out of position to a point where it would cease to properly function as a guide. Furthermore, such designs fail to provide a tab that provided a wide support face. As depicted, however, at the forward end of the baseplate 230 a first bottom wall 235 is provided that is joined to a second bottom wall 237 by an interconnecting shoulder 236. These first and second bottom wall 235, 237 are offset, with the first bottom wall 235 configured to be spaced away from a supporting circuit board, while the second wall 237 is positioned closer to the supporting circuit board 20. This construction allows the resultant opening 206 to be positioned slightly above its supporting circuit board 20 and can improve ease of assembly of a corresponding plug connector. The front bottom wall 235 has a front edge that aligns with the front edges of the port 205 and completes the perimeter of the opening 206. A series of guides 233 can be formed in the baseplate 230 and extend up from the second wall 237. The top surfaces of these guides 233 can be aligned with the plane formed by first wall 235 so as to provide additional support for a plug connector as it is inserted into the port 205. Alternatively, the guides can extend further into the enclosure.

Figure 24:
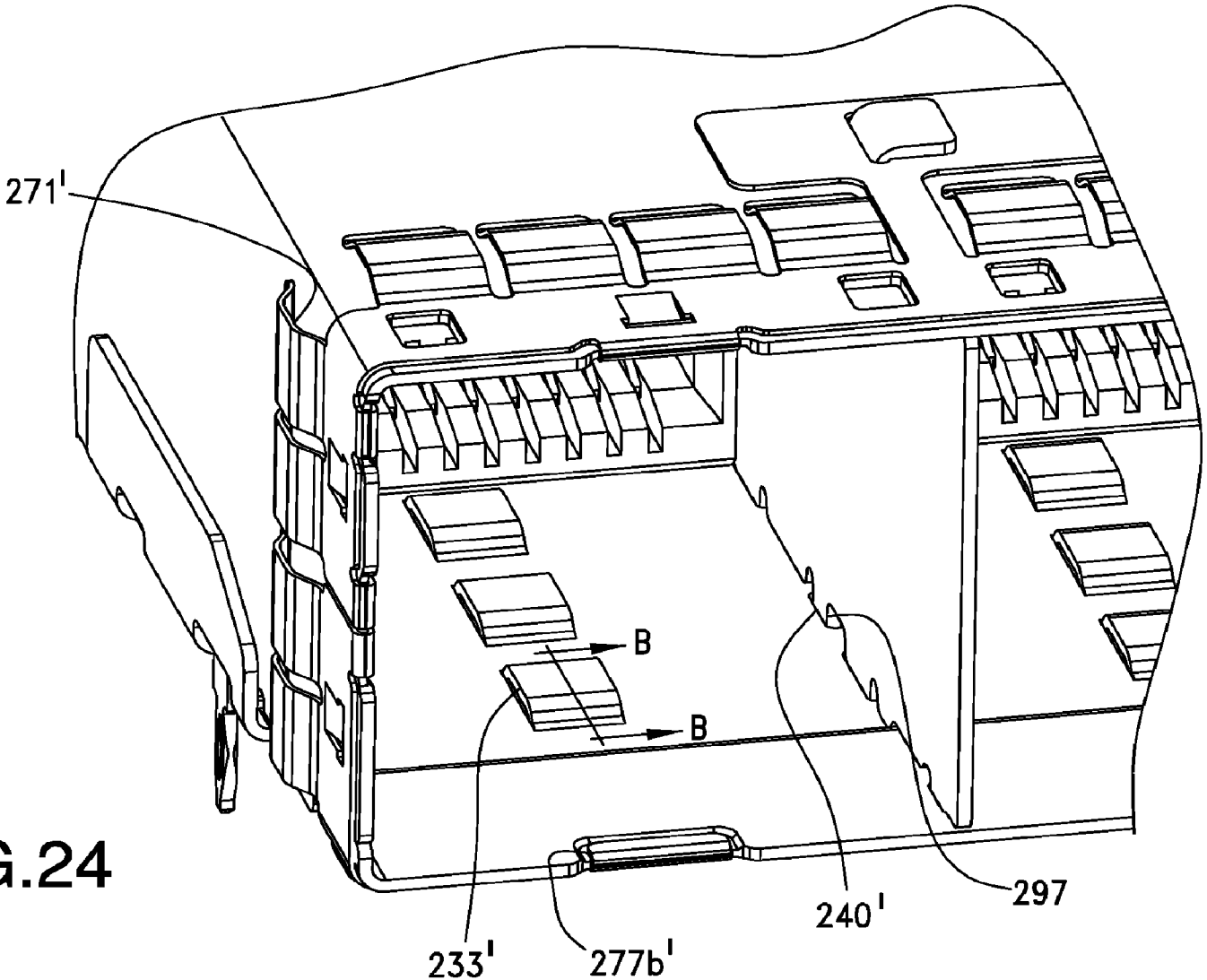
FIG. 24 is the same view as FIG. 23, but taken from an upward angle to show a portion of the interior of one of the connector receiving bays.
Figure 24A:
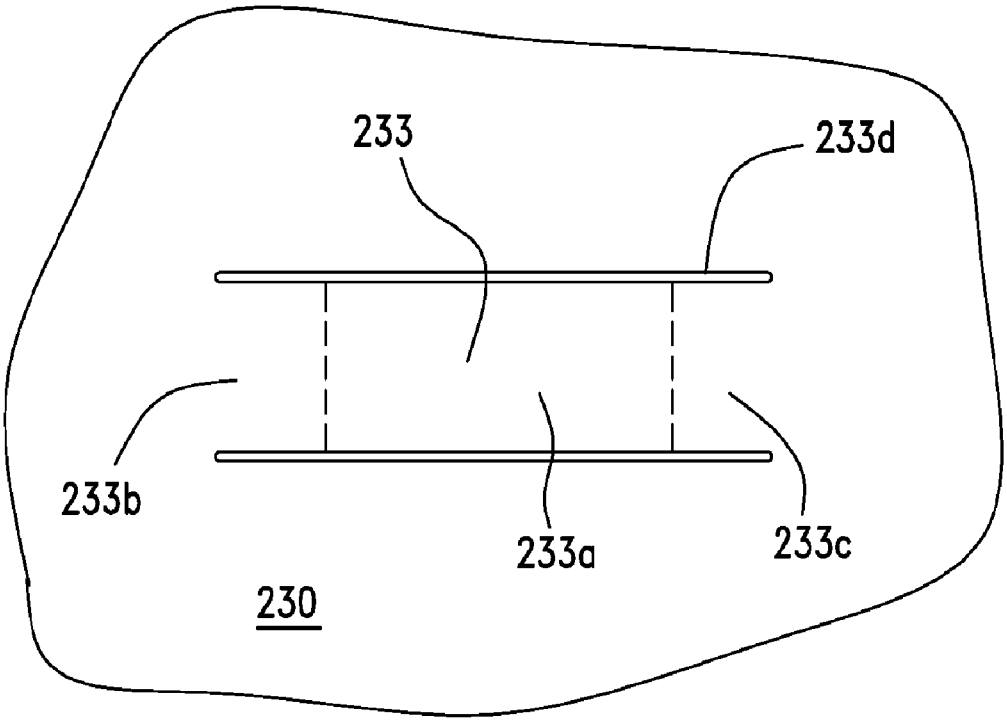
FIG. 24A is a top plan view of one of the internal guides of the shield of FIG. 24.
Figure 24B:
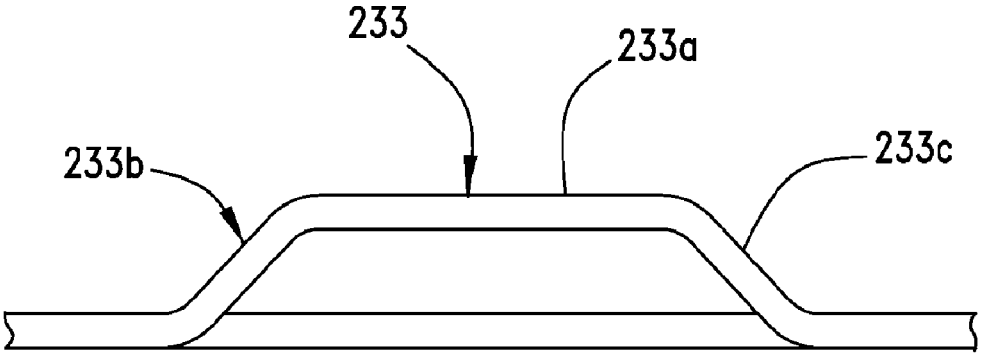
FIG. 24B is a sectional view of the connector housing baseplate of FIG. 24, taken along lines B-B thereof.

FIG. 24A shows one of the guide 233' of the enclosure of FIG. 24. FIGS. 24A &B illustrate the structure of an embodiment of the guides 233. As depicted, the guides 233 can be formed by "lancing" the baseplate 230. A lancing process can be used to form a pairs of slits 233*d*, which are preferably parallel to each other. The slits can extend completely through the thickness of the baseplate 230. Each pair of slits 233*d* defines a single guide 233 and the guide may be formed so that it is pushed above second wall 237 of the baseplate 230. Preferably, the resultant form is rectangular or trapezoidal in configuration as shown. As can be appreciated, the forming of the guide above the plane of the baseplate 233 can result in a slight elongation of the material as well as a slight reduction of its thickness.

The guide 233, as formed has a body portion with a top surface 233*a* (e.g., the support surface) that is interconnected by shoulders 233*b*, 233*c* to the baseplate 230. Thus, each guide 233 is connected to the baseplate 230 at two locations on opposite ends of top surface 233 and is inherently stronger than if formed in the conventional cantilevered manner. The guides 233 are shown in an illustrative embodiment of a pattern where all of the guides are aligned together along a common longitudinal axis, and this is shown in FIG. 26A, where it can be seen that the top surfaces of the guides 233 are all aligned with each other and the first bottom wall 235 of the baseplate 230 and further generally lie in a common plane "P". As shown below, the guides 233 may also be arranged in two rows and may also be arranged in some other pattern on the baseplate 230.

Figure 18:
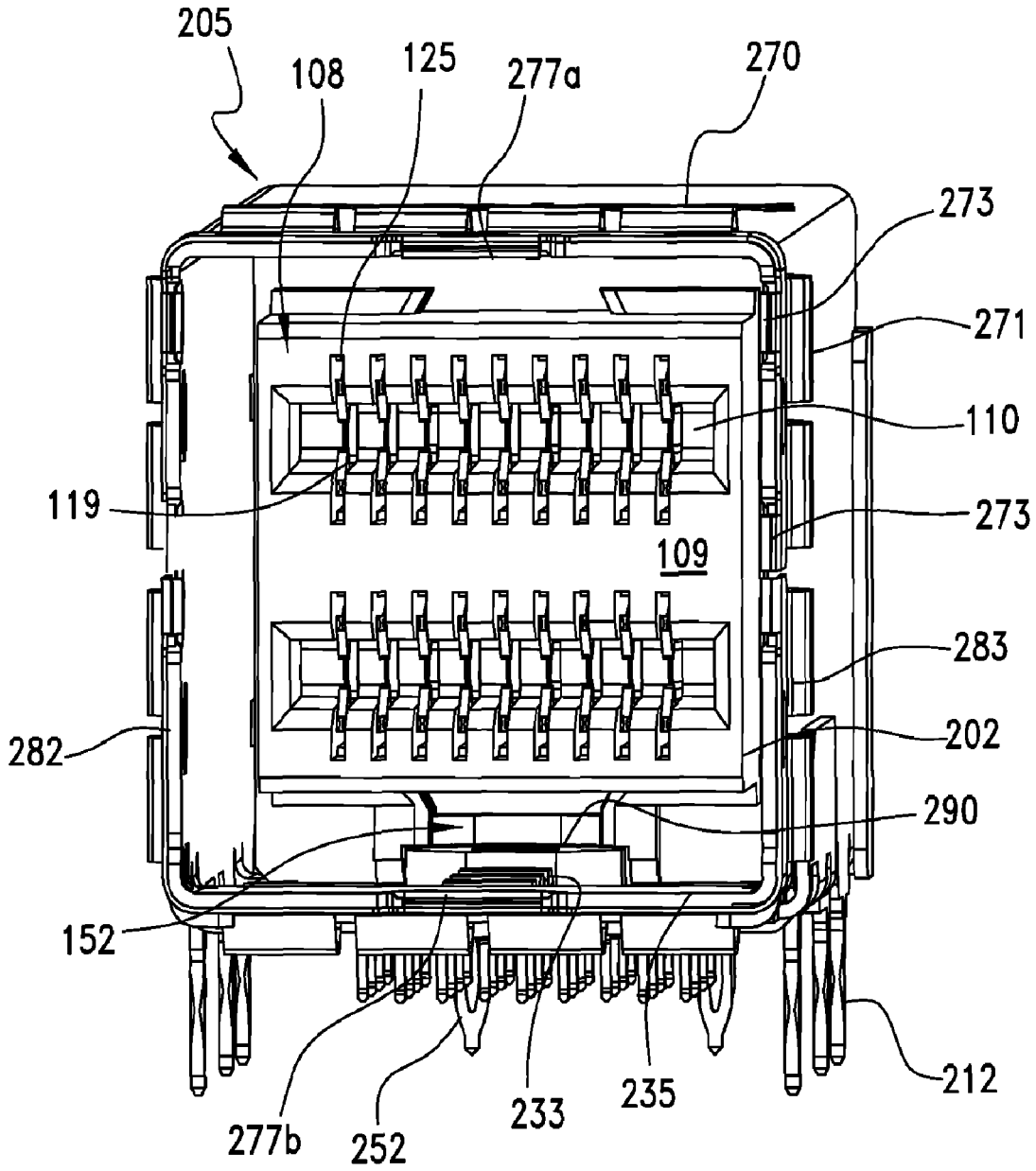
FIG. 18 is a front elevational view of the shield of FIG. 5.
Figure 19:
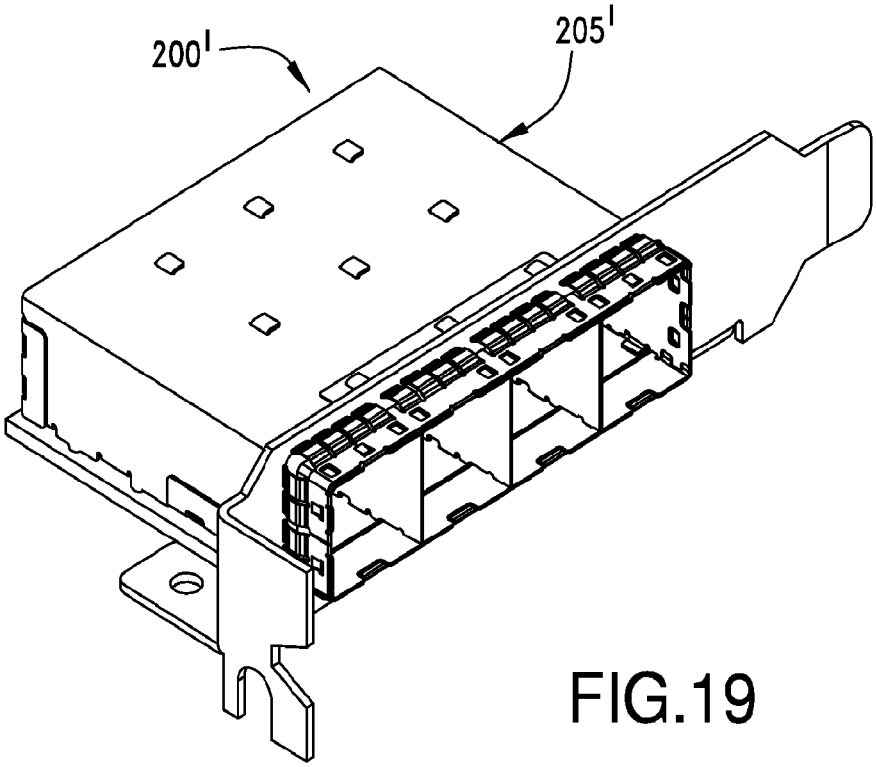
FIG. 19 is a perspective view of a ganged shield with four separate connector receiving bays arranged in an adjacent orientation, and inserted into the opening of a mounting bracket.
Figure 20:
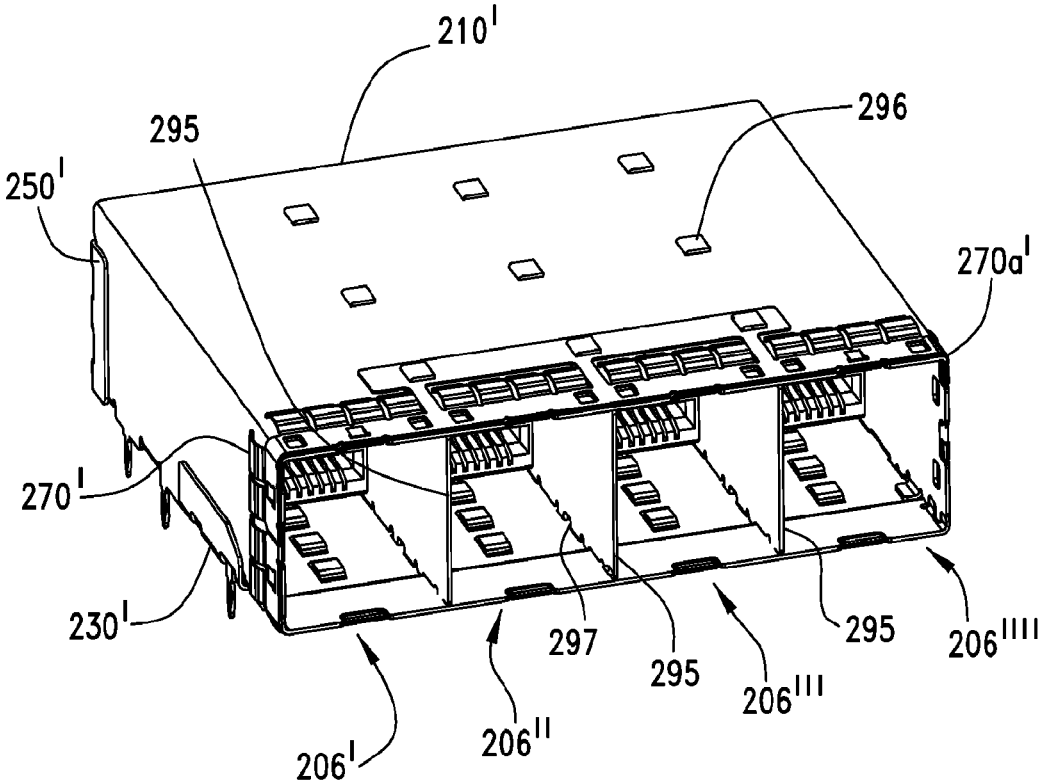
FIG. 20 is the same view as FIG. 19, but with the mounting bracket removed.
Figure 21:
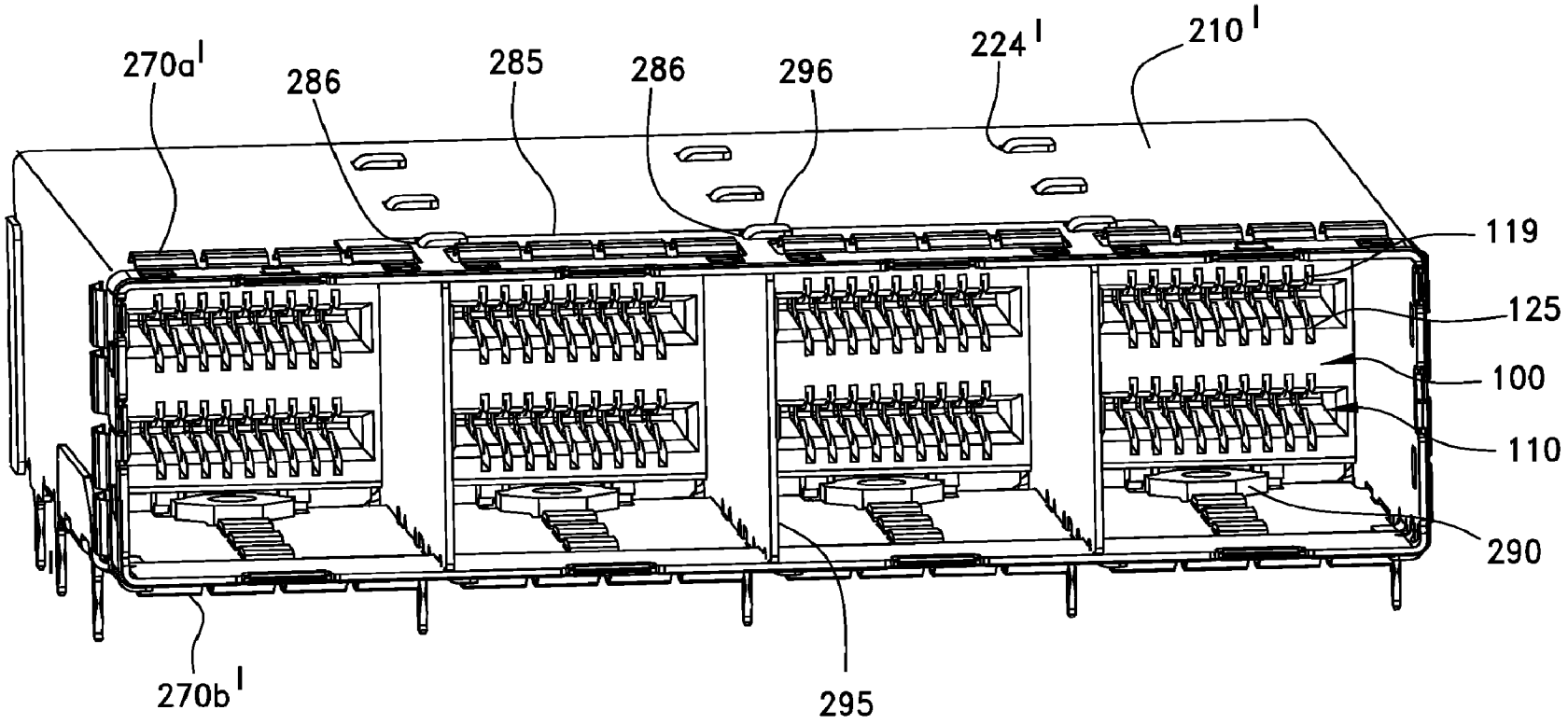
FIG. 21 is a front elevational view taken from slightly upward angle of the ganged shield of FIG. 20.
Figure 23:
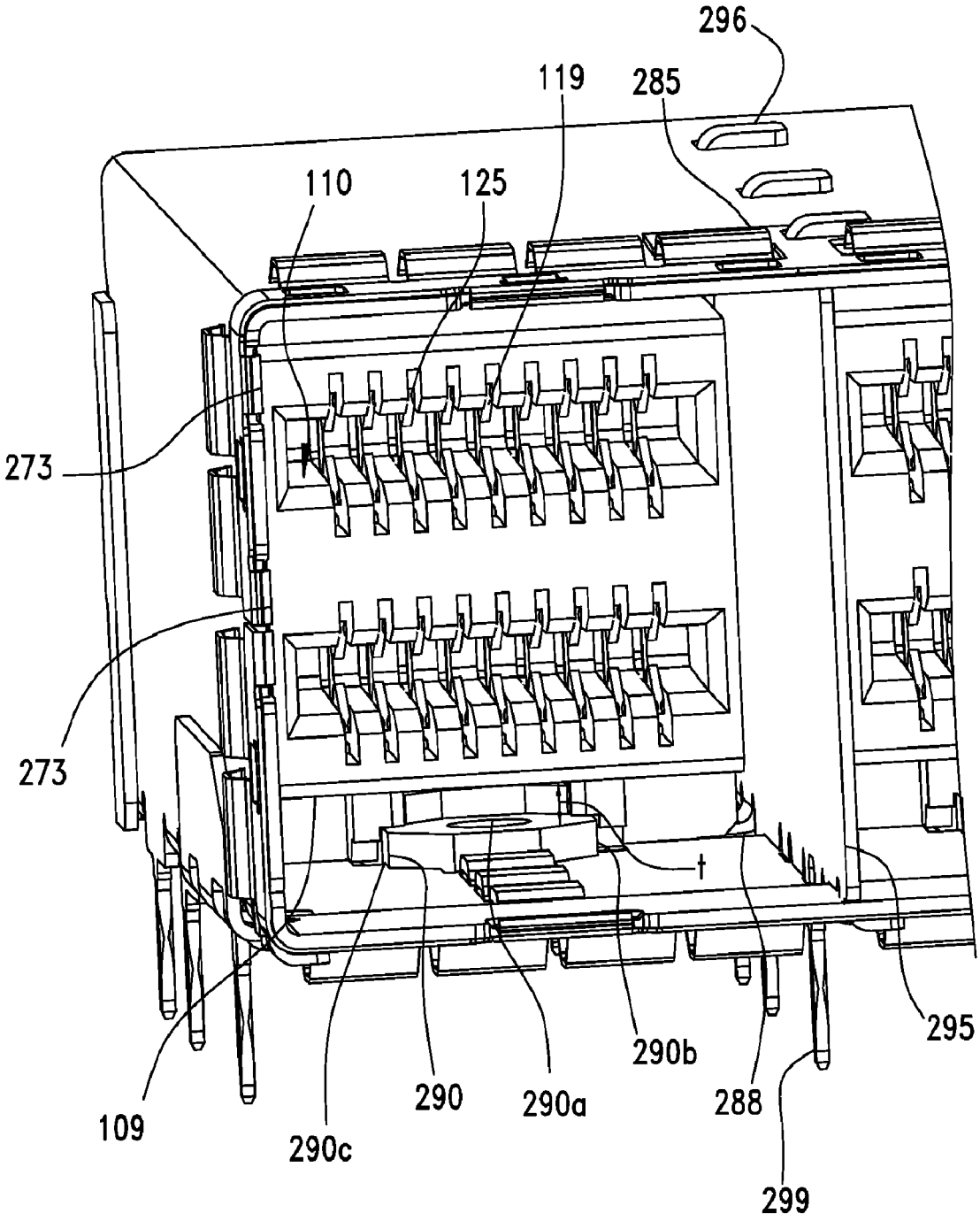
FIG. 23 is an enlarged detail view of the interior of one of the bays of the ganged shield of FIG. 20.

As illustrated in FIG. 18, a space may be provided between threaded member 290 and the underside of the sub-assembly 202, which may be a given height t (as shown in FIG. 23). This allows a matter connector to be inserted therebetween while a portion of the sub-assembly engages the threaded member 290.

FIGS. 19-22 illustrate an embodiment of a shield 200' that has a port array 205' that provides a ganged receptacle connector with distinct openings 206', 206'', 206''', and 206'''' so as to provide four ports. Separating the openings are dividing walls 295, which include first projections 296 that secure the dividing walls 295 to cover 210' and second projections 297 that secure the dividing walls 295 to the baseplate 230'. As can be appreciated, therefore, the general construction of the port array 205' may be substantially the same as discussed above with respect to port 205, with the exception of the inclusion of the dividing walls 295 and the increased dimensions of the port array 205' and corresponding cover 210' and baseplate 230'.

It should be noted that the EMI gasket, while extending across four ganged openings, is still a largely a two-piece design. While such a construction is not required, the benefits of the design include reducing piece count. As can be appreciated, a top engagement tab 296 on the top edges of each of the dividing walls 295 are received within respective openings 286 formed in a retaining plate 285 formed as part of the EMI gasket upper half 270*a'* and which secures it to the cover 210'. A similar feature is provided for securing the lower EMI gasket half 270*b'* to the baseplate 230' in the form of a second EMI tab 298 that engages the EMI gasket half 270*b'*.

Figure 22:
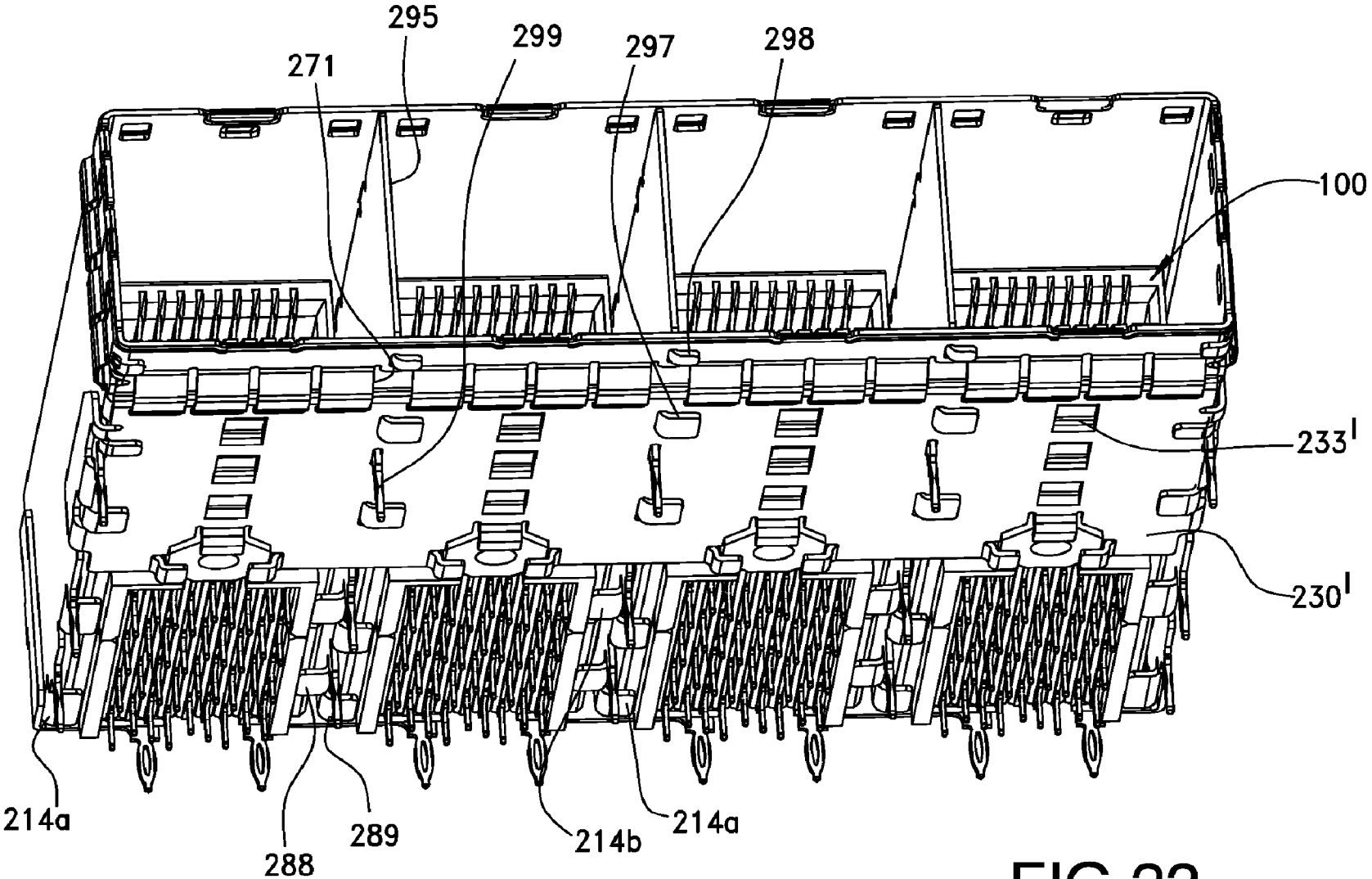
FIG. 22 is a view of the underside of the ganged shield of FIG. 21.

As can be further appreciated, the dividing wall 295 further may include support tabs 288, 289 that are used to support the sub-assembly positioned in each of the ganged connectors. In an embodiment, the tabs may be bent in alternating first and second directions. The divider further includes a plurality of board-mounting tails 299. In an embodiment, a tail may be positioned between two support tabs 288 and/or between two support tabs 289. The dividing walls 295 may further include tabs that engage the rear plate 250' in a manner similar to how the tabs 296 engage the cover 210'. Still further, additional connector engagement tabs 214*a'*, 214*b'* are formed along the lower edges thereof and bent in opposite direction, as shown in FIG. 22 so as to contact the connector housings placed in adjacent bays.

As can be appreciated, therefore, the cover and the baseplate and the rear plate, in combination with N-1 dividers can provide a ganged connector configured to receive N plugs. Thus, a 1×2 configuration, a 1×3 or a larger 1×5+ configuration is possible. For many applications, however, the 1×4 connector will be the maximum desired size because it provides four receptacles for connectors while still fitting on a standard PCI card.

Figure 26:
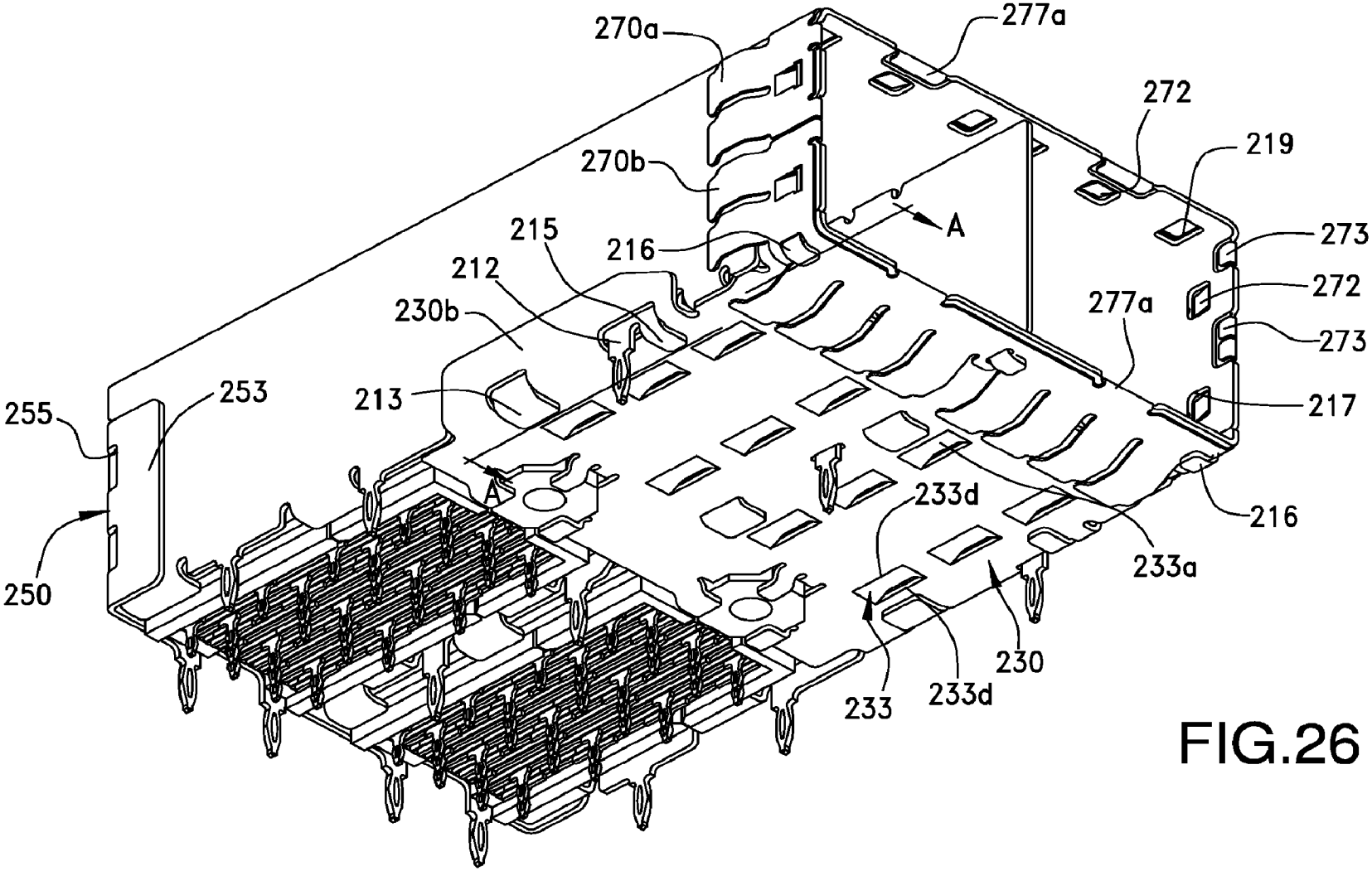
FIG. 26 is a perspective view of an embodiment illustrating a ganged shielding housing bay.
Figure 26A:
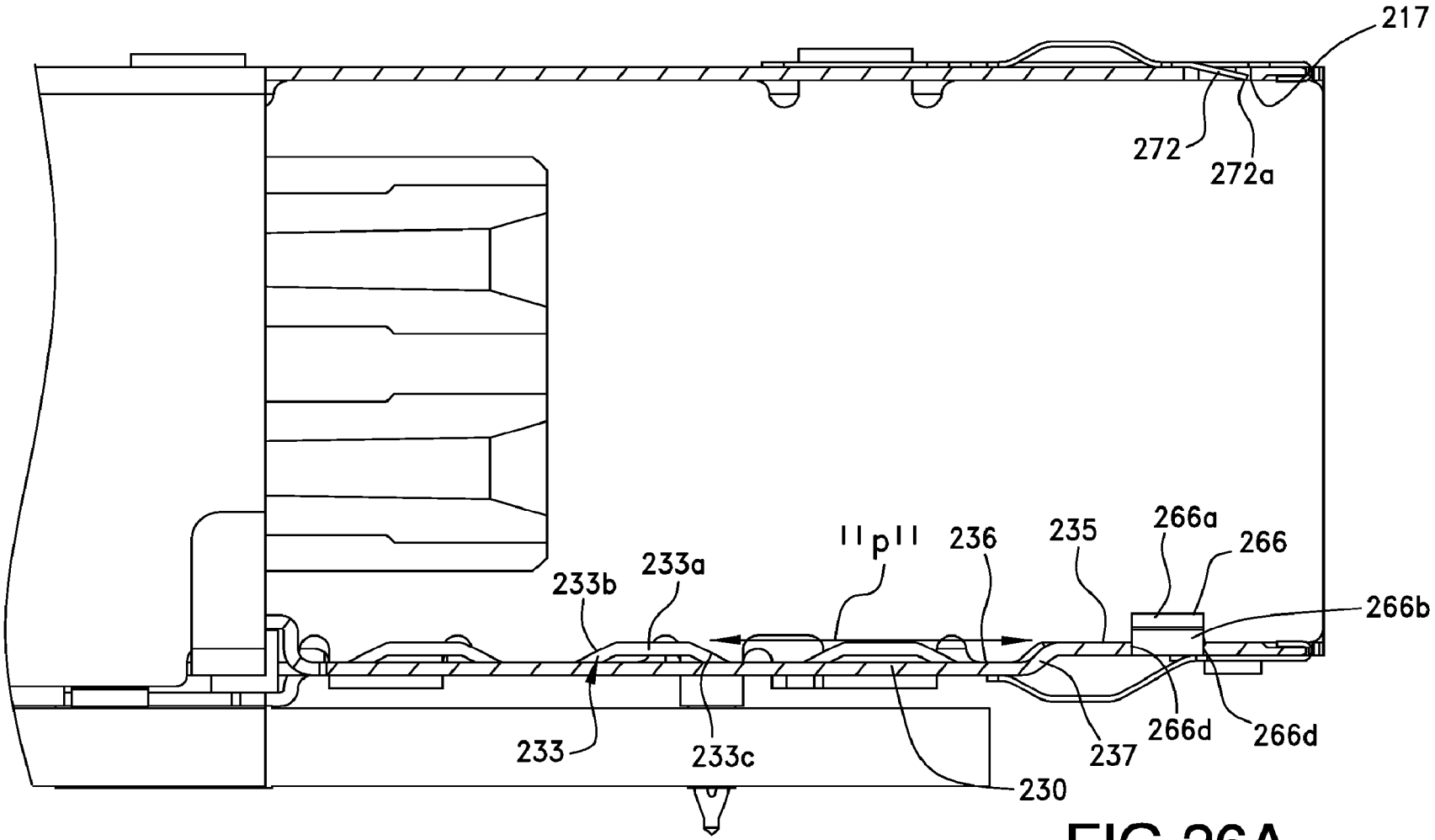
FIG. 26A is a sectional view of the assembly of FIG. 26, taken generally along lines A-A thereof.
Figure 27:
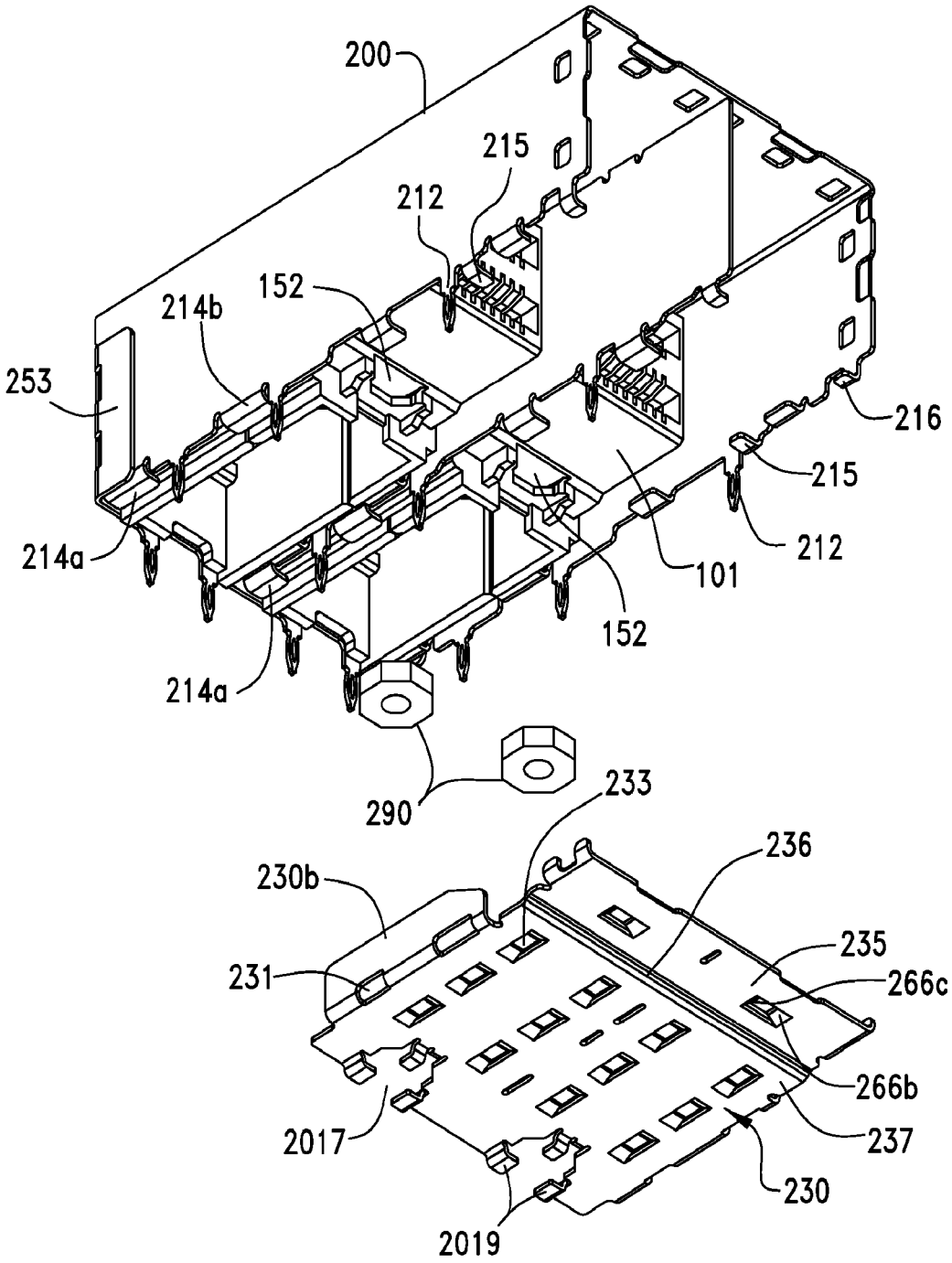
FIG. 27 is the same view as FIG. 26, but with the connector terminal assemblies, the housing baseplate and fastening nut removed clarity.
Figure 28:
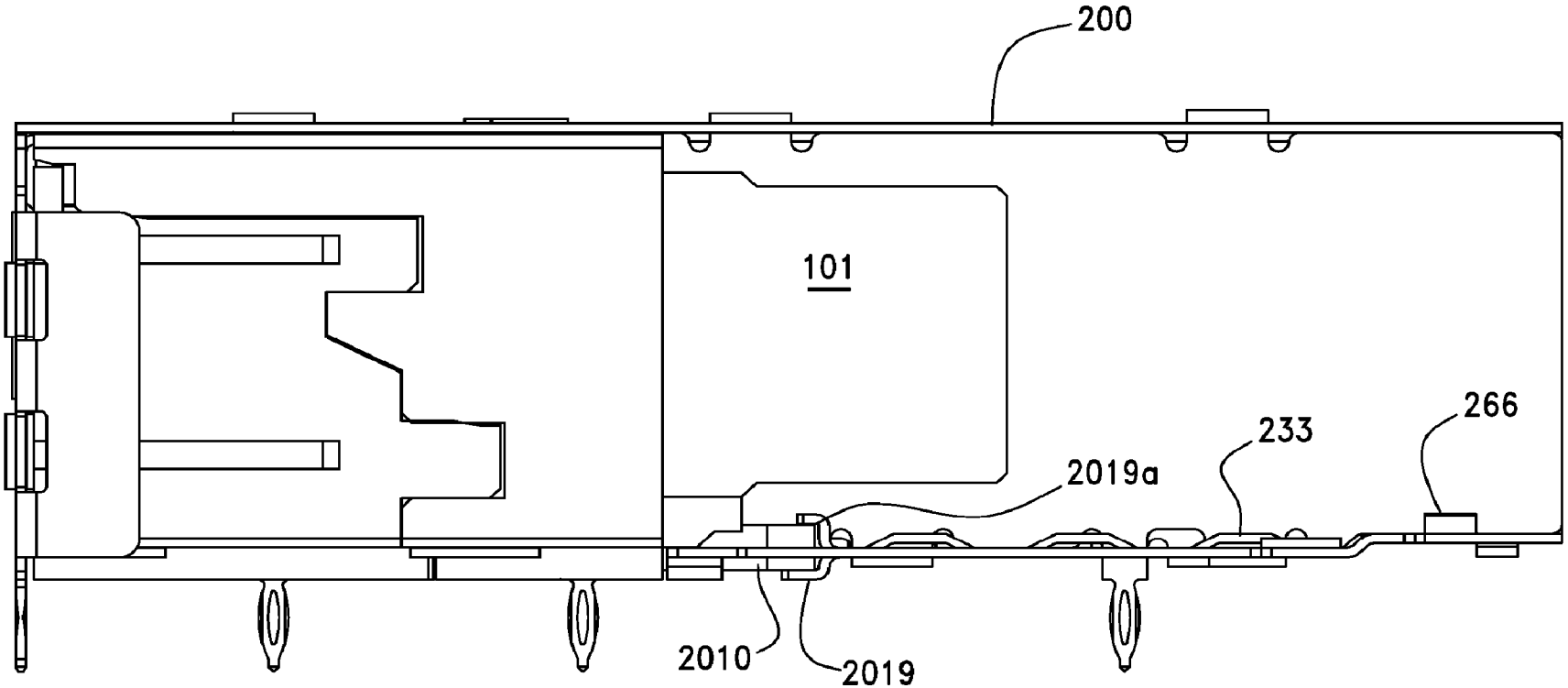
FIG. 28 is a view of the connector assembly of FIG. 27 taken from right side with the right sidewall thereof removed to show the interior of one of the housing bays.

As shown in FIGS. 26-27, the enclosure may be further configured to hold a fastening nut in place so that it may be engaged with a screw or bolt or the like from underneath the circuit board 20'. In this regard, the baseplate 230 of the shield 200 is provided with a means in engaging the fastening nut 290. This fastener-engagement means takes the form of a slot, or opening, 2017 that is preferably formed in alignment with the connector housing lower engagement recess 152, which also accommodates the nut 290. The baseplate 230 has three tabs 2019 formed therewith that are disposed there on so as to confront three flat surfaces, or flats of the nut. These retention tabs 2019 cooperate with the flat surfaces of the connector housing 2010 arranged in half-hexagon to effectively capture the nut 2010 in place. Additionally, because the tabs extend beneath the nut 2010 and between it and the surface of the circuit board, the tables 2019 act together as would a lock washer. The placement of such a washer would be difficult given the environment in which the shields and connectors are used and the tabs eliminate the need in such washers. Although in this embodiment, the bottom engagement recess 152 of the connector 100 is shown as multi-faceted (having multiple interconnected flat sides that make contact with opposing flat surfaces on the fastening nut), such surfaces are not required. Additionally, some of the tabs 2019a may be bent above the opening 2017 so that the nut 290 may be inserted into the assembly before the connector housing 101 is inserted into the enclosure 200 and so the nut 290 is retained in place in it opening.

Figure 25:
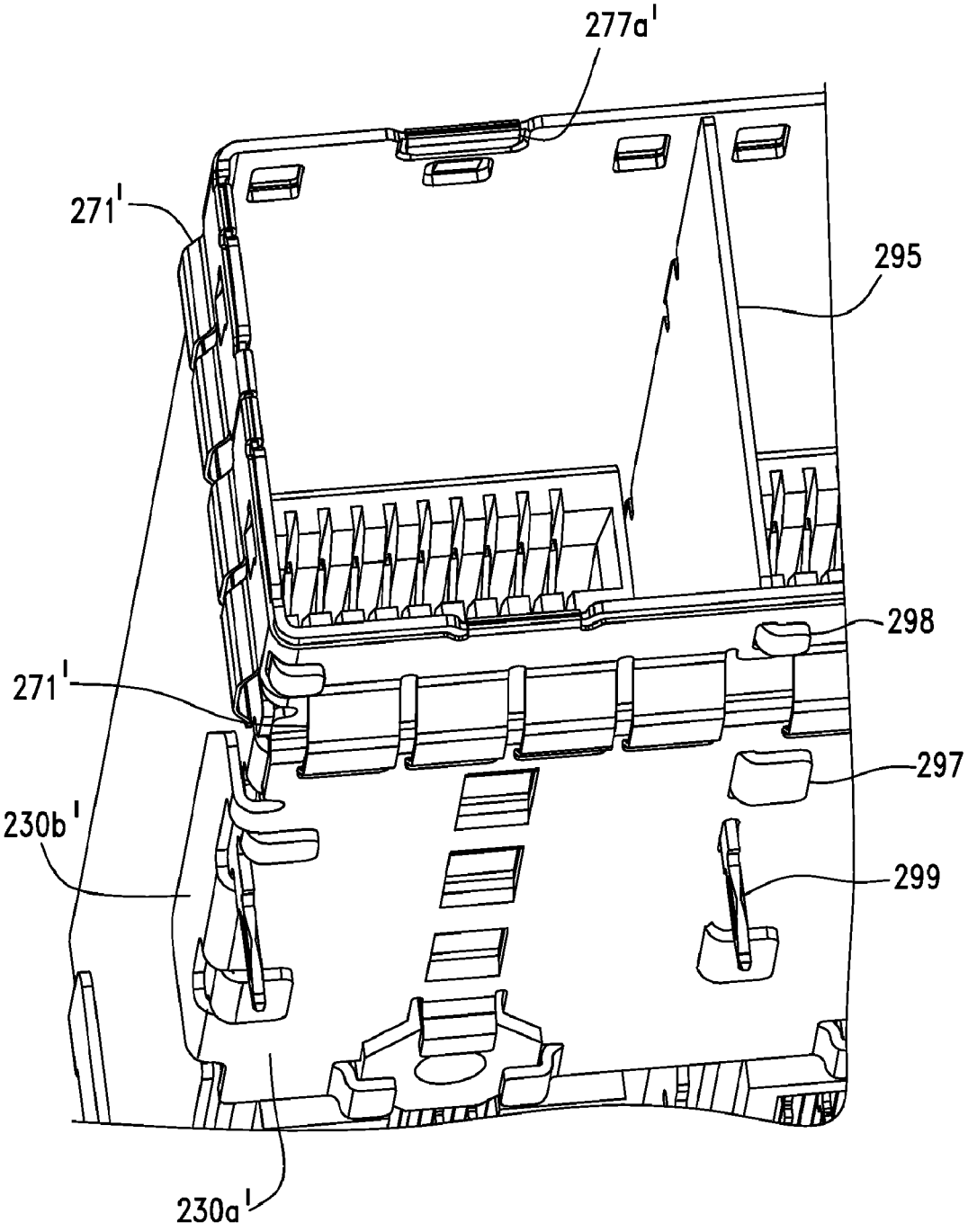
FIG. 25 is the same view as FIG. 24, but taken from the underside thereof.
Figure 29:
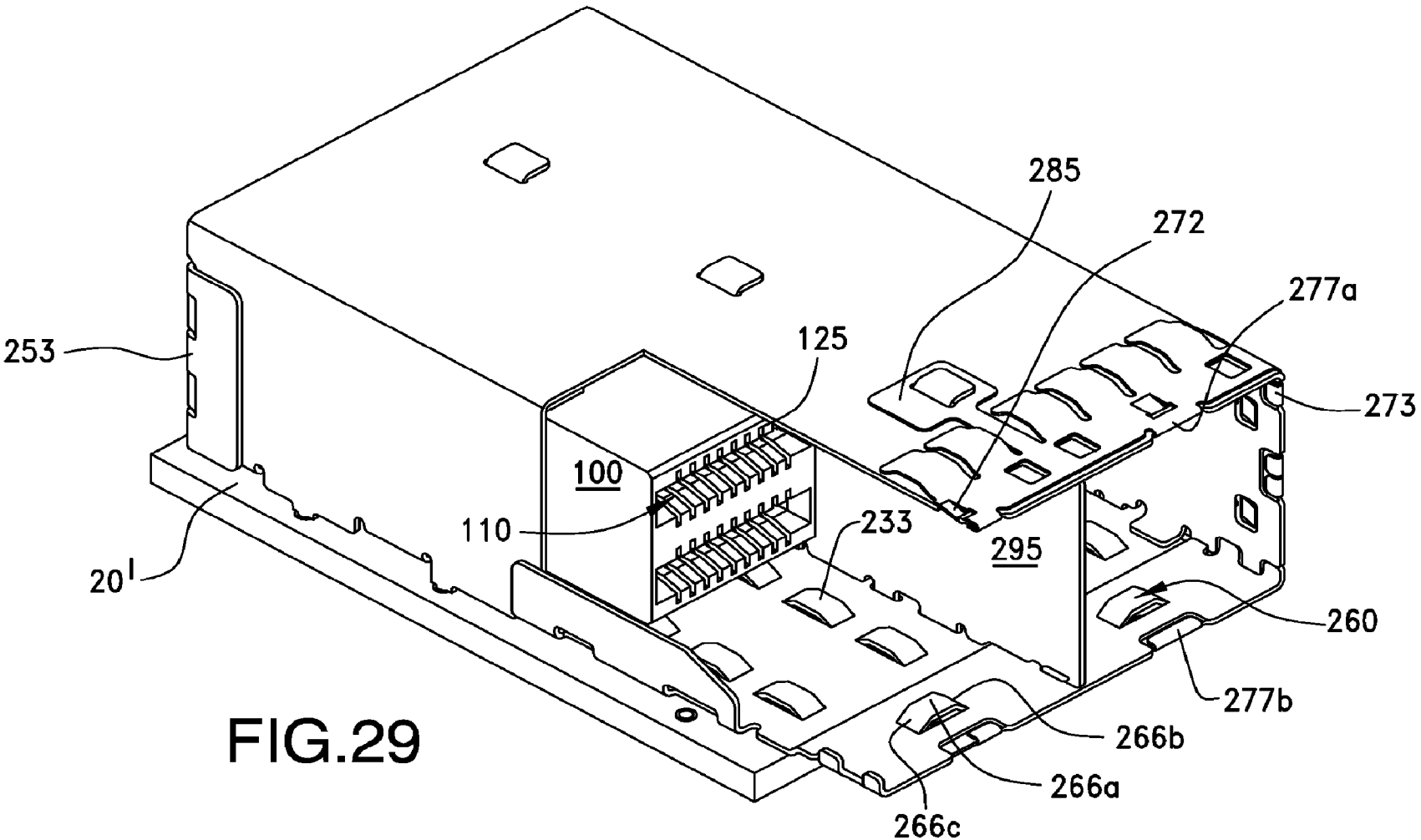
FIG. 29 is a view of the shield assembly of FIG. 26 mounted to a circuit board and a portion of the sidewall and top wall removed to show a portion of the interior of one of the housing connector-receiving bays with its dual row of connector guides and keys that are formed in the baseplate of the housing.
Figure 30:
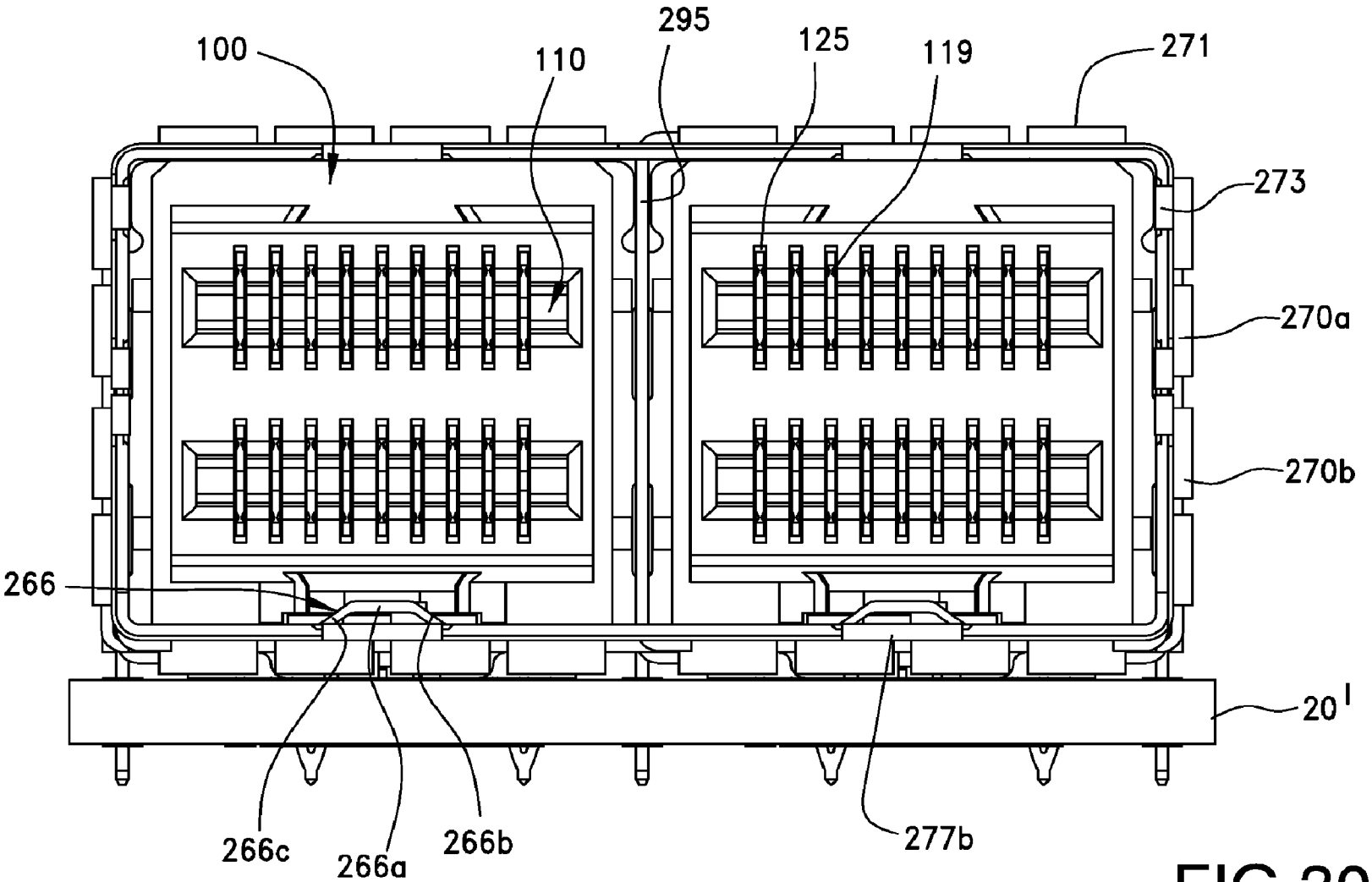
FIG. 30 is a front elevational view of the connector assembly of FIG. 27.

In an embodiment, as can be appreciated from the embodiments depicted in FIGS. 24-30, the baseplate 230 of the shroud 200 may be further lanced and formed to provide a series of raised elements, or guides, 233 that may be aligned in a pattern in each port provided by the port array. As depicted, the pattern may be a pair of longitudinal rows (as shown in FIGS. 27-31) or a single row (as shown in FIGS. 24 and 25) or some other desirable pattern. Thus the baseplate 230 can provide a plurality of patterns with each pattern aligned with one of the passageways formed by the shield. The guides 233 can be positioned so as to properly direct an opposing connector or module into alignment with the card-receiving slots 125 of the connector housing 101. Preferably the pattern is repeated in each port so as to ensure consistent control and alignment of the inserted plug. As shown in FIG. 29 these guides extend from proximate the housing opening to the mating face (and can be positioned underneath it) of the interior connector 100.

Figure 31:
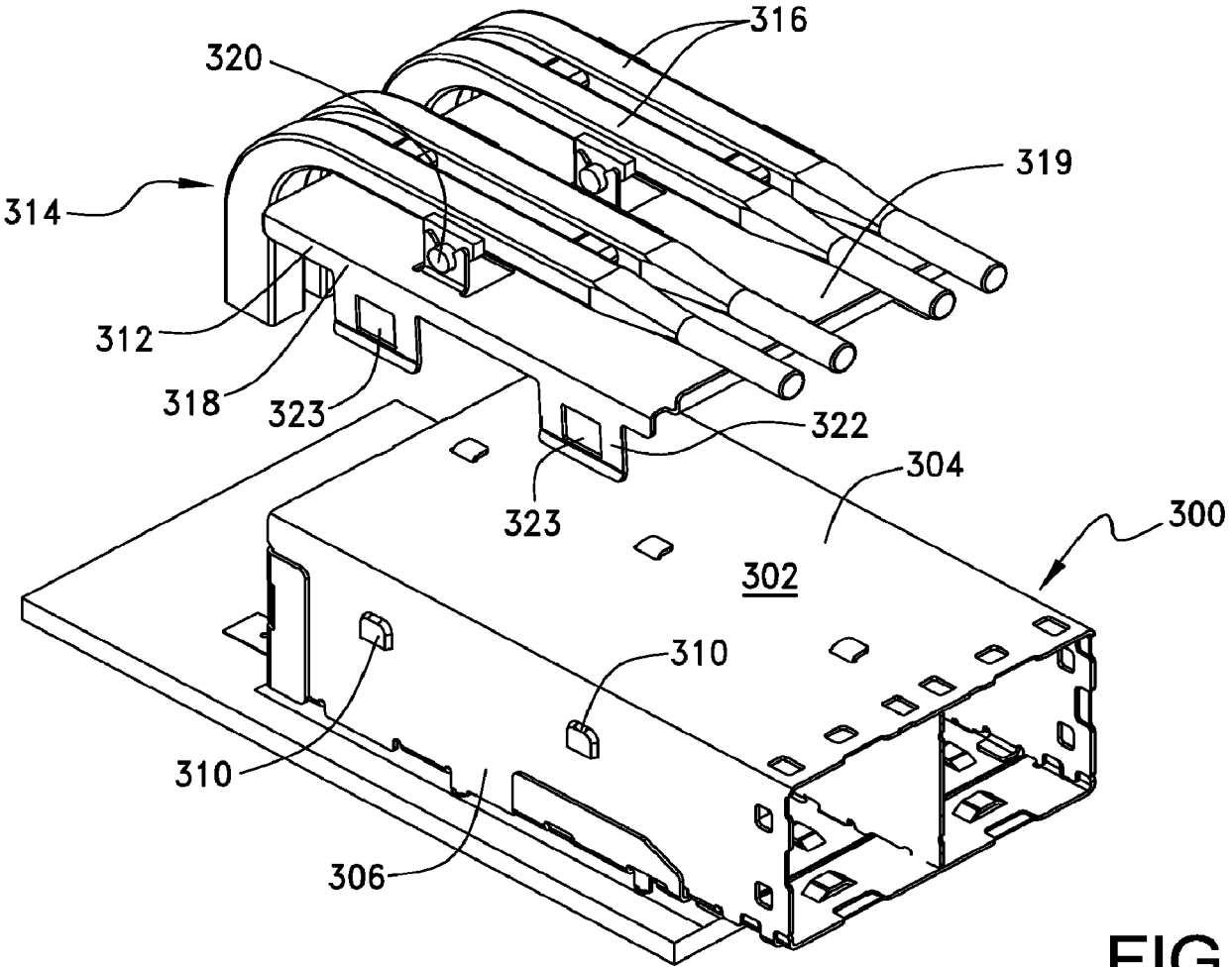
FIG. 31 is a perspective view of the shield and an ancillary component, illustrated as a light pipe carrier aligned therewith but spread apart therefrom.
Figure 32:
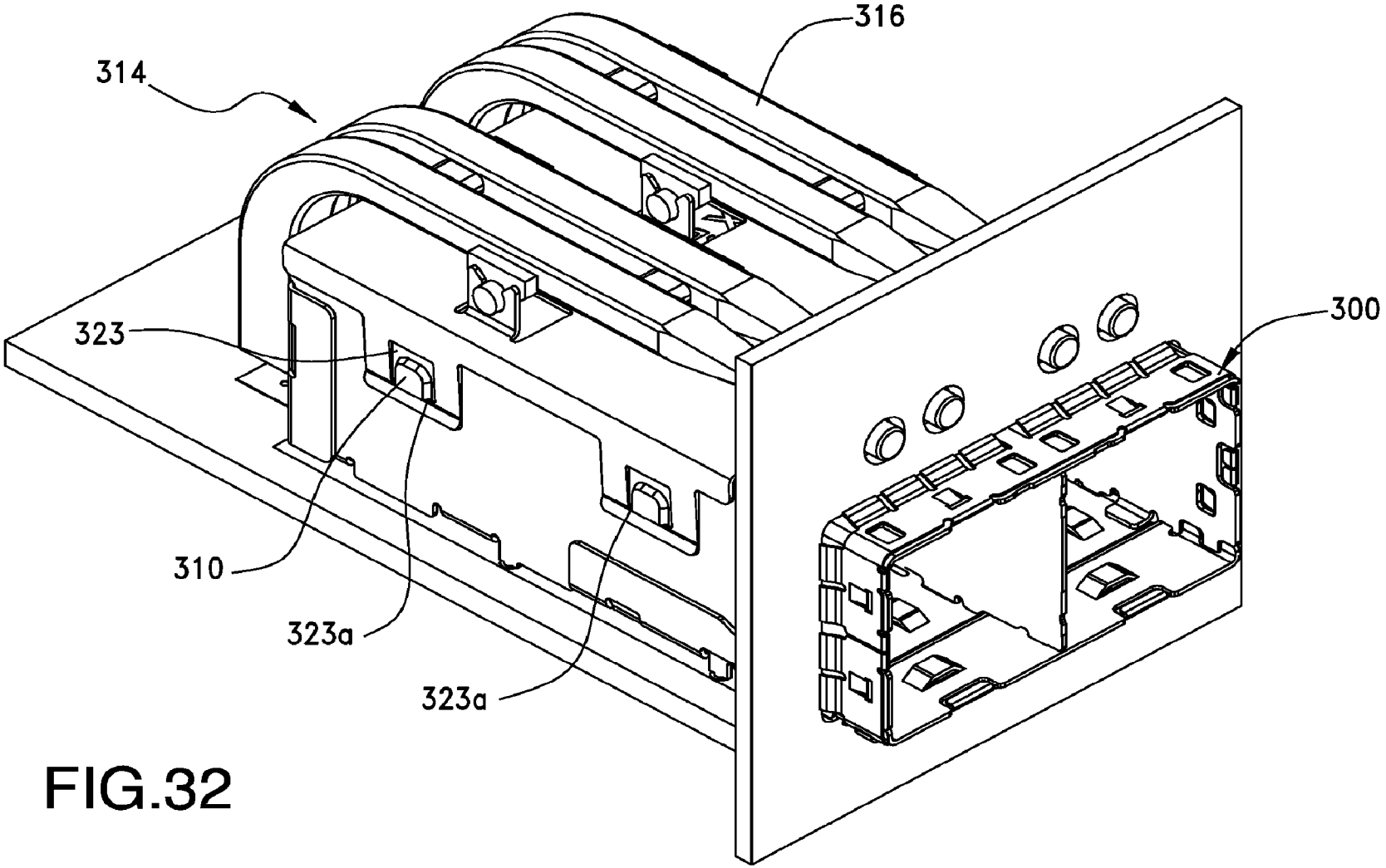
FIG. 32 is the same view as FIG. 31 but with the light pipe carrier attached to the housing and the housing inserted into a mounting bracket opening.
Figure 33:
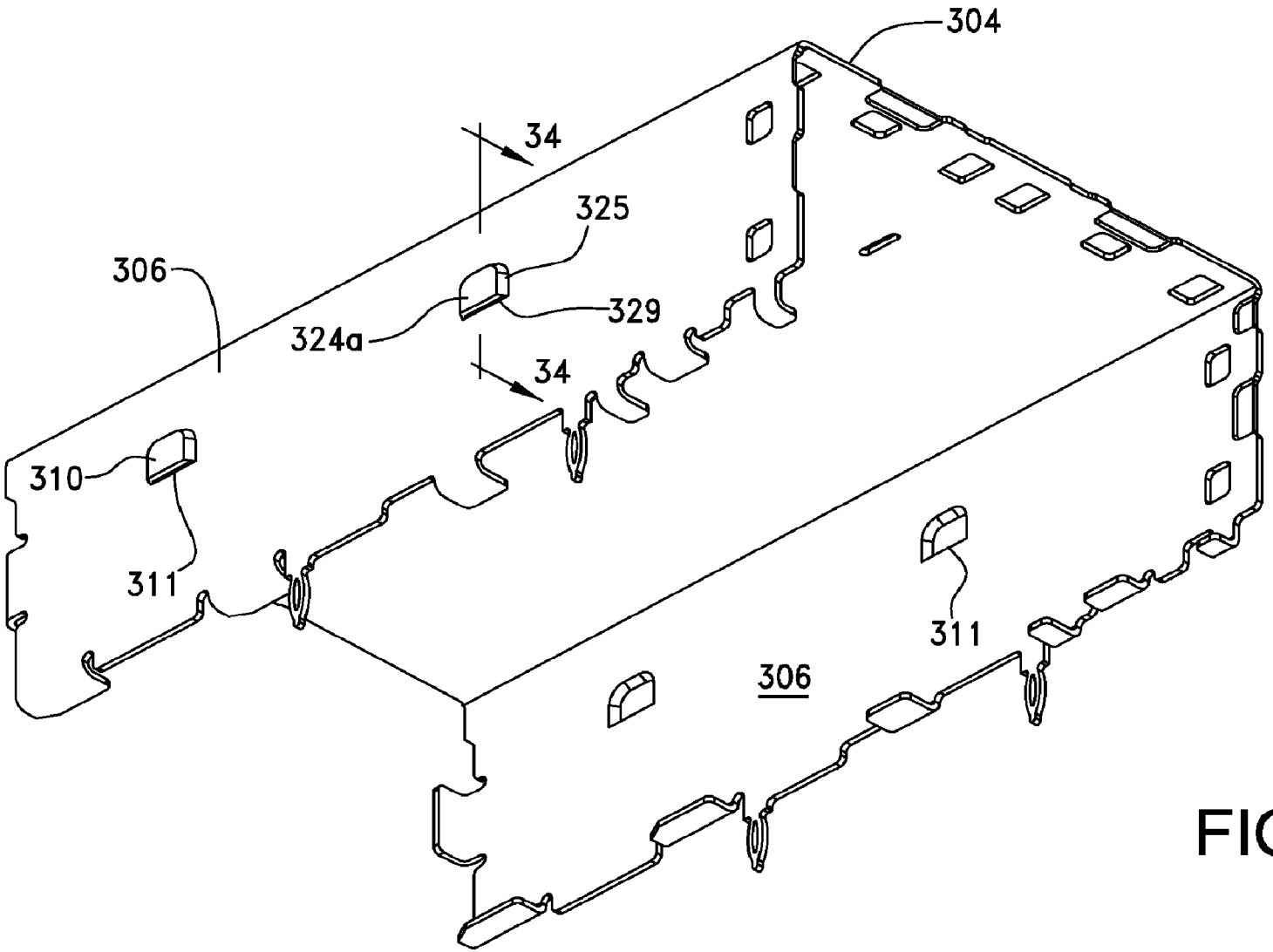
FIG. 33 is a perspective view of the upper housing portion of the shield of FIG. 31 illustrating the lanced retaining members formed in the sidewalls thereof.
Figure 34:
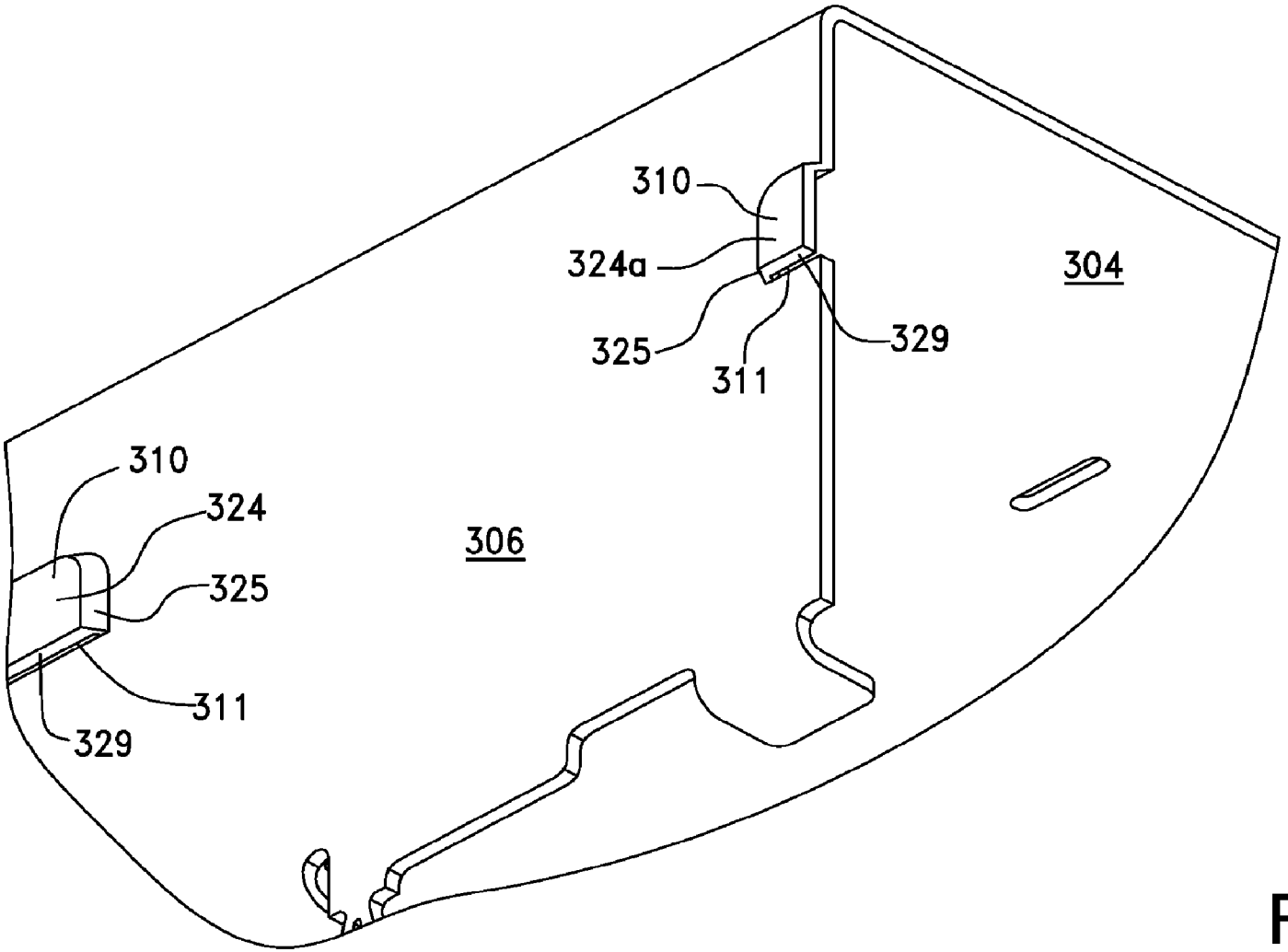
Figure 35:
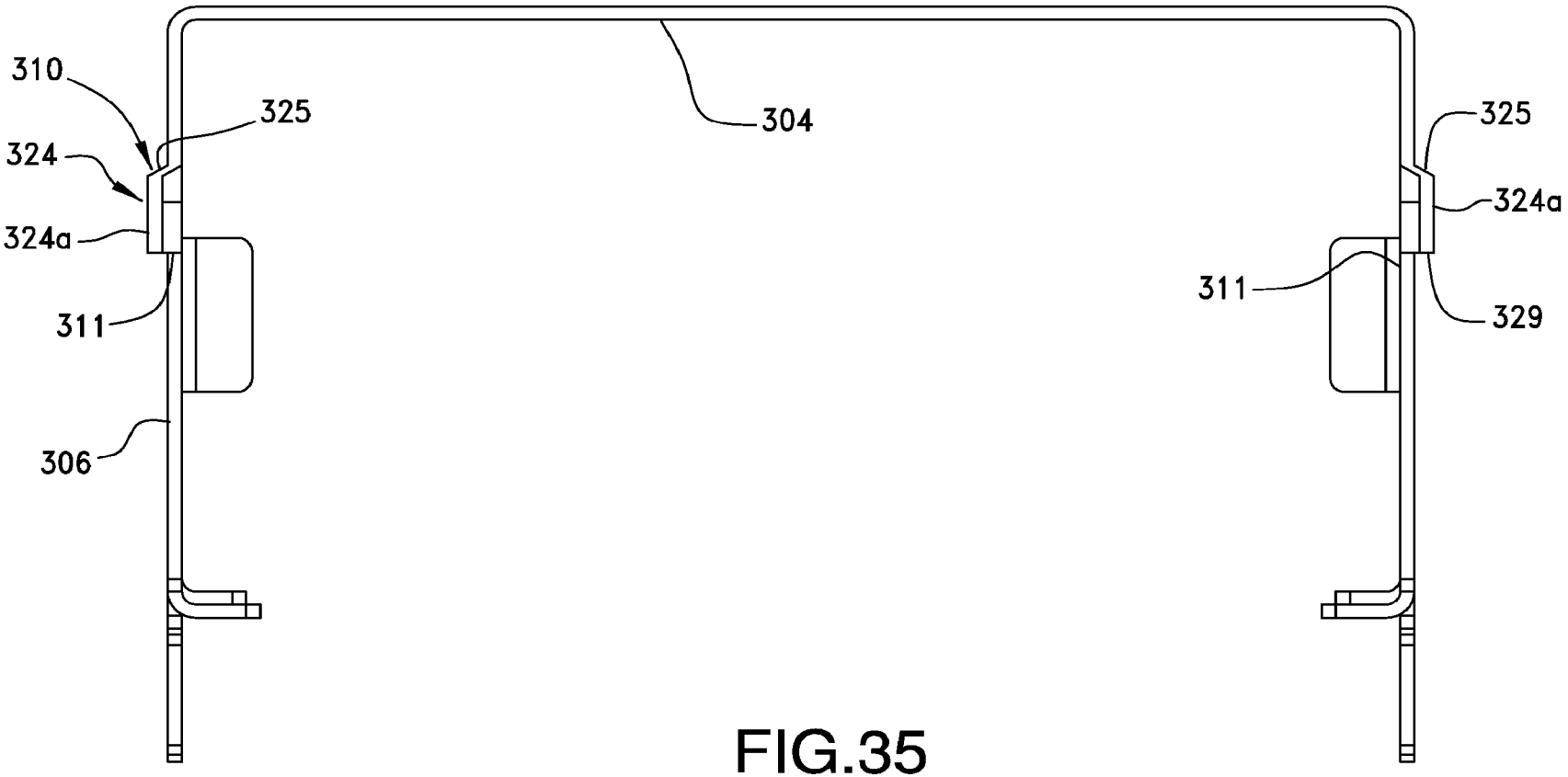
FIG. 35 is a detailed sectional view of the lanced retaining member of FIG. 33, taken along lines 34-34 thereof; and, FIG. 35 is a front elevational view of the upper housing of FIG. 33.

One such guide acts as a key 266 is disposed proximate to the housing opening and arranged transversely to a longitudinal axis of the housing opening so as to provide a polarizing, or keying, feature that will fit a recess formed on the underside of an opposing plug connector. This key 266 is shown disposed on the bottom wall of the housing, but it will be understood that it may be formed on any of the sides of the housing provided it can engage a mating connector. This key 266 is formed from the material between two slits 266*d* that are formed in the baseplate 230. That material defines a body portion 266*a* that is connected to the baseplate 230 by two end or leg portions 266*b*, 266*c*. Its two points of connection, as well as its widthwise orientation within the housing bay, provide the key with a measure of strength that will resist forces that may be generated by stubbing and initial misalignment FIGS. 31-35 illustrate an additional embodiment of a shield 300 in which the sidewalls 300 are lanced to provide support members in ancillary components. As shown in FIG. 31, the shield 300 includes a cover 302 with a top wall 304 and two sidewalls 306, shown formed as a single piece. The sidewalls 306 each include a pair of retaining members 310 disposed thereon and spread apart from each other. In an embodiment, the retaining members 310 can be arranged so as to form a horizontal line.

These retaining members 310 extend outwardly (out of plane) from the sidewalls 306 to provide projections that, as depicted, may be engaged by opening in auxiliary member 312. In an embodiment, auxiliary member 312 can support an array 314 of light pipes 316 that are shown in FIG. 31 as supported on a carrier 318. The carrier 318 has a top plate portion 319 with light pipe supports 320 integrally formed therewith with it along its top plate portion 319 and further includes a series of clips 322 that extend downwardly from the top plate portion 319. AS depicted, clips 322 are generally square in configuration and have a central opening 323 disposed therein. The central opening 323 fits over the retaining member 310 so that the lower edge 323*a* of each clip opening 323 lies beneath and in opposition to a lower edge 329 of the retaining member 310.

As mentioned earlier, the retaining member 310 may advantageously be formed using a lancing process where a slit 311 is formed in the sidewall 306 that extends completely through the sidewall 306. In this fashion, the lower edge 329 of the retaining members 310, which lie adjacent to slit 311, is then pressed outwardly to create outwardly projecting body portion projections 324 with outer surfaces 324*a* and continuous sides 325 that are attached to the housing sidewalls 306. The lower edge 329 of the retaining member can be a "hard" edge, meaning it lies adjacent to slot 311 and can provide a right angle. As such, it is capable of reliably engaging the lower edge 323*a* of the clip opening 323 and thus helps secure the clip 322 in place. Importantly, the retaining member lower edge 329 is connected at both its ends to the housing sidewalls, as are the aforementioned guides and keys, and it is incapable of extending over the top of the clip opening lower edge 323*a* and the clip 322 itself because its lower edge serves as a stop. As such, the retaining members 310 of the present invention not only provide reliable retention to the carrier 318, but also provide easy removal thereof, which is accomplished by lifting the lower edge 323*a* of the clip 322 up over the lower edge 329 of the retaining member 310. The attachment of the lower edge 329 at its ends reduces the possibility that the retaining member will then interfere with the removal of the carrier 318.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations. These modifications and/or combinations fall within the art to which this invention relates and are intended to be within the scope of the claims, which follow. It is noted, as is conventional, the use of a singular element in a claim is intended to cover one or more of such an element.

What is claimed is:

1. A shield for housing a first connector, comprising:

a cover having a top wall and two sidewalls, the two sidewalls spaced apart and coupled along a corresponding edge by the top wall to provide a U-shape configuration;

a baseplate coupled to both sidewalls, the sidewalls, the top wall and the baseplate forming an opening on a front side of the shield;

a rear plate coupled to the cover along edges of the top wall and the two sidewalls, the combination of the rear plate, the cover and the baseplate forming a bottom opening and the rear plate, the cover and the baseplate defining a port having a hollow interior portion; and a plurality of guides disposed on the baseplate in a pattern, the plurality of guides positioned between the opening and the bottom opening, each of the plurality of guides including a body portion having a substantially flat top portion that extend into the hollow interior portion above the baseplate and is connected to the baseplate at two locations.

2. The shield of claim 1, further including a plurality of pairs of slits disposed in the baseplate, each of the slits extending completely through a thickness of the baseplate in a first direction, wherein each pair of slits defines a body portion of a single guide.

3. The shield of claim 2, further comprising a key formed from two slits, the two slits of the key being orientated in a second direction that is perpendicular to the first direction.

4. The shield of claim 3, wherein the key has a trapezoidal configuration.

5. The shield of claim 1, wherein the pattern comprises two rows of guides.

6. The shield of claim 1, wherein the rear plate includes side panels that form a U-shape and a portion of the sidewalls and the side panels overlap.

7. The shield of claim 1, wherein the two sidewalls include a plurality of engagement tabs disposed along bottom edges thereof, and the baseplate includes a plurality of slots aligned with the sidewall bottom edges, the engagement tabs extending through the baseplate slots and engaging the baseplate to retain the baseplate in place.

8. The shield of claim 7, wherein the sidewalls further including two board-mounting tails, each of the board-mounting tails extending through one of plurality of slots, wherein the engagement tab and the board-mounting tail are positioned adjacent each other.

9. The shield of claim 1, further including a plurality of retaining members that include outwardly extending projections, and slits formed in the sidewalls and extending completely there through and disposed adjacent the projections, one slit being associated with a single projection, the slits defining lower, linear edges of the projections and a lead in portion formed on the projection opposite the corresponding linear edge.

10. The shield of claim 1, wherein the plurality of guides are positioned in a single row, the row extending into the shield in a direction parallel with the direction of insertion of a mating connector.

11. A connector assembly including a port, the assembly comprising:

a housing positioned in the port and supporting a plurality of wafers, each wafer including a plurality of terminals having contact portions and tail portions at opposite ends thereof, the connector housing having at least one card-receiving slot defined in a mating face thereof, the plurality of terminals in each wafer including a first terminal with a first contact portion on a first side of the card receiving slot and a second terminals with a second contact portion on a second side of the card receiving slot, the housing further including a mounting face from which the terminal tail portions extend; and a shield forming an enclosure for the port, the shield including:

a cover including two sidewalls coupled together by a top wall, the cover having a U-shape;

a rear plate coupled to the cover along edges of the cover;

a baseplate coupled to the sidewalls of the cover, the baseplate, cover and rear plate providing a first opening and a bottom opening, the first opening providing access to the at least one card-receiving slot and the bottom opening allowing the tail portions of the terminal to extend beyond the enclosure so as to engage, in operation, a supporting circuit board;

a plurality of guides disposed on the baseplate in a pattern; and a key positioned on the baseplate adjacent the first opening, the key including a body portion defined by a pair of slits in the baseplate, the body portion extending transversely in the enclosure and supported on two sides.

12. The assembly of claim 11, wherein both the baseplate and the rear plate include side panels that form a U-shape and the sidewalls form overlapping portions with the side panels of both the baseplate and the rear plate, wherein a first engagement tab from each sidewall extends through a slot in the baseplate and a second engagement tab from each sidewall extends through a slot in the rear plate, the first and second engagement tab securing the respective sidewall to the baseplate and rear plate.

13. The assembly of claim 11, wherein the baseplate includes a first bottom wall that supports the key and a second bottom wall that supports the plurality of guides, the first bottom wall positioned closer to the top wall than the second bottom wall.

14. The assembly of claim 13, wherein each of the plurality of guides is formed by a pair of slits that a body portion, the body portion extending above the second bottom wall so as to be aligned with a plane defined by the first bottom wall.

15. The assembly of claim 13, wherein the assembly comprises a second port with another housing positioned therein, the second port sharing the cover, the baseplate and the rear plate with the first port, the shield further comprising a dividing wall positioned between the two ports, the pattern formed by the plurality of guides being the same in each port.

16. The assembly of claim 15, wherein each of the plurality of guides include body portions that are coupled to the baseplate at opposite ends.

17. The assembly of claim 16, where the guides are arranged in two rows.

18. The assembly of claim 11, wherein each sidewall includes a retaining member projecting outwardly therefrom, each retaining member including a drawn body portion formed in the sidewalls with a linear retaining edge defined by a slit formed through the sidewall.

19. The assembly of claim 18, wherein the retaining member body portion is connected to the sidewalls at opposing ends of the linear retaining edge.

20. The assembly of claim 18, wherein the drawn body portion formed on each retaining member has a lead in formed opposite the linear retaining edge.

21. A shield, comprising:

a cover including a top wall and two sidewalls, the top wall and the two sidewalls formed of a single piece and having a U-shape configuration;

a rear plate coupled to the cover;

a baseplate coupled to the cover, the cover, the rear plate and the baseplate defining an enclosure configured to receive a mating connector;

a plurality of guides disposed on the baseplate in a pattern;

a retaining member disposed on each of the sidewalls, each retaining member including a drawn body portion formed in the sidewalls with a linear retaining edge defined by a slit formed through the sidewall and a lead in formed on the drawn body portion opposite the retaining edge.

22. The shield of claim 21, further comprising a lightpipe assembly, the lightpipe assembly including clips mounted to the retaining members and a plurality of lightpipes, the plurality of lightpipes configured in operation to direct light from a supporting circuit board toward a front face of the shield.

* * * * *